US010724193B2

(12) United States Patent
Petty et al.

(10) Patent No.: US 10,724,193 B2
(45) Date of Patent: Jul. 28, 2020

(54) SWEEPING MACHINE HAVING IMPROVED SURFACE SEAL

(71) Applicant: Roadtec, Inc., Chattanooga, TN (US)

(72) Inventors: Chris Petty, Calhoun, GA (US); Brent Michaels, Flat Rock, AL (US)

(73) Assignee: Roadtec, Inc., Chattanooga, TN (US)

( * ) Notice: Subject to any disclaimer, the term of this patent is extended or adjusted under 35 U.S.C. 154(b) by 920 days.

(21) Appl. No.: 15/357,255

(22) Filed: Nov. 21, 2016

(65) Prior Publication Data

US 2017/0145645 A1 May 25, 2017

Related U.S. Application Data

(60) Provisional application No. 62/259,168, filed on Nov. 24, 2015.

(51) Int. Cl.
*E01H 1/04* (2006.01)
*E01H 1/05* (2006.01)

(52) U.S. Cl.
CPC ..... *E01H 1/045* (2013.01); *E01H 1/04* (2013.01); *E01H 1/042* (2013.01); *E01H 1/05* (2013.01); *E01H 1/056* (2013.01); *E01H 1/047* (2013.01)

(58) Field of Classification Search
CPC .. E01H 1/045; E01H 1/01; E01H 1/04; E01H 1/05; E01H 1/056
USPC ..... 15/82, 78, 52.1; 299/36.1; 404/83
See application file for complete search history.

(56) References Cited

U.S. PATENT DOCUMENTS 2,548,676 A 4/1951 Milz et al.
2,711,551 A 6/1955 Wagner et al.
3,071,793 A 1/1963 Lull
3,649,985 A 3/1972 Hunt
4,200,953 A 5/1980 Overton
4,678,365 A 7/1987 Ban et al.
5,560,065 A 10/1996 Young
5,991,953 A 11/1999 Durenberger et al.
6,006,390 A * 12/1999 Bischel ..... E01H 1/056 15/340.3
6,035,478 A * 3/2000 Miller ..... A46B 13/02 15/82
6,421,870 B1 7/2002 Basham et al.
(Continued)

FOREIGN PATENT DOCUMENTS

WO WO 2004/063477 A2 * 7/2004

OTHER PUBLICATIONS

Co-pending Application—International Search Report and Written Opinion of counterpart PCT Application No. PCT/US2016/63099 dated Feb. 2, 2017.

(Continued)

*Primary Examiner* — Randall E Chin

(74) *Attorney, Agent, or Firm* — Chambliss, Bahner & Stophel, P.C.

(57) ABSTRACT

A vehicular sweeping machine includes a frame and a broom assembly that is mounted to the frame. The broom assembly includes a broom enclosure and a broom that is mounted within the broom enclosure. A plurality of links are pivotally mounted between the frame and the broom assembly. These links are adapted to permit the broom assembly to move upwardly and downwardly with respect to the frame. The vehicular sweeping machine also includes a broom conveyor having a lower end that is disposed within the broom enclosure.

16 Claims, 23 Drawing Sheets

(56) References Cited

U.S. PATENT DOCUMENTS

| | | | | |
|---|---|---|---|---|
| 6,622,336 | B2 | 9/2003 | Jackson | |
| 6,672,675 | B1 | 1/2004 | Swain | |
| 6,877,180 | B2 | 4/2005 | Wilmo et al. | |
| 6,981,820 | B2 | 1/2006 | Nelson | |
| RE38,973 | E | 2/2006 | Smith | |
| 7,520,017 | B2 | 4/2009 | Wilmo et al. | |
| 7,651,295 | B2 | 1/2010 | Eppes et al. | |
| 7,793,376 | B2 | 9/2010 | Rush, Sr. et al. | |
| 8,914,933 | B1 | 12/2014 | Petty et al. | |
| 2004/0045111 | A1 | 3/2004 | Engel et al. | |
| 2005/0060834 | A1 | 3/2005 | Strauser | |
| 2011/0209886 | A1 | 9/2011 | Gendelman et al. | |
| 2014/0245644 | A1* | 9/2014 | Kois | E01H 5/061 37/279 |

OTHER PUBLICATIONS

Counterpart Application—International Search Report and Written Opinion of counterpart PCT Application No. PCT/US2016/63099 dated Feb. 6, 2017.

* cited by examiner

SWEEPING MACHINE HAVING IMPROVED SURFACE SEAL

CROSS-REFERENCE TO RELATED APPLICATION

This application claims the benefit of U.S. Provisional Patent Application No. 62/259,168 which was filed on Nov. 24, 2015.

FIELD OF THE INVENTION

The invention relates generally to a vehicular sweeping machine that may be used in sweeping streets, parking lots and other large surfaces. More particularly, the invention relates to a vehicular sweeping machine having a sweeping apparatus including a broom assembly that is adapted to provide an improved seal of the surface of the roadway.

BACKGROUND OF THE INVENTION

Roadway repair is often accomplished by overlaying the existing pavement (whether of concrete or asphalt composition) with a new layer (often called a leveling course) of concrete, asphalt or other surfacing materials. Without prior surface treatment, however, this method of repair generally results in the application of insufficient quantities of paving material in the rutted, potholed or otherwise damaged areas, because the overlay will be applied at the same rate per unit of roadway width in damaged areas (which have a greater depth across the width) as in the undamaged areas. The resulting reduced density in the overlay of the previously damaged areas will lead to renewed rutting or other wear damage in the new pavement in relatively short order. However, by milling the surface of the damaged pavement, the milled surface may be rendered substantially flat so that newly added pavement will have a uniform thickness across the entire width of the roadway. In addition, a repaving technique that includes milling a thickness of old pavement and replacing it with an equivalent thickness of new pavement will return the elevation of the roadway to its initial level, whereas the placement of a leveling course atop damaged pavement will tend to raise the surface of the roadway or some portion thereof above its original elevation. This can require the raising of road shoulders, guardrails and manhole covers and the adjustment of overpass clearances, all of which are unnecessary if a proper milling technique is employed. A use of milling prior to repaving can also permit ready establishment of the proper road grade and slope, and thereby avoid drainage and safety problems. Furthermore, milling typically provides a rough surface that readily accepts and bonds with the new asphalt or other pavement overlay. Finally, milling can provide raw material that can be reclaimed for use in the production of new paving materials.

A milling machine is typically a wheeled or track-driven vehicle that is provided with a rotating drum that includes a plurality of cutting teeth. The drum is mounted in a housing on the frame of the machine and adapted to be lowered into contact with the road surface and rotated about a horizontal axis so as to cut into the surface to a desired depth as the machine is advanced along the roadway. Generally, the milling machine also includes a conveyor system that is designed to carry the majority of the milled material that has been cut from the roadway by the rotating drum to a location in front of, to the rear of or beside the machine for deposit into a truck for removal from the milling site. Sweeping machines are frequently required, however, to follow a milling machine in order to remove any milled material left behind by the milling machine prior to resurfacing.

Conventional sweeping machines typically employ a broom assembly comprising one or more brooms mounted for rotation about horizontal or vertical axes. Some conventional machines may operate by pushing the swept material to one side of the machine where it may be collected by a separate collecting device. Other conventional machines include a broom assembly and an integral assembly for collecting material swept by the broom or brooms. Such integral collecting assemblies may comprise vacuum systems for capturing the material swept by the brooms or discharge conveyors for transporting such material to a hopper or an adjacent truck. Most conventional sweeping machines having an integral collecting assembly are not enclosed or are not sufficiently enclosed to avoid leaving material on the roadway. Many such machines must make multiple passes along a roadway to clear the roadway sufficiently to allow for resurfacing.

Some sweeping machines that include integral collecting assemblies employ flexible flaps and end gates on the broom assembly in an attempt to seal the broom assembly to the roadway surface and prevent material from escaping from the broom assembly enclosure. Unfortunately, conventional flaps and end gates do not always retain the milled material within the broom assembly. In addition, some of these machines may trap material within the broom only to eject it onto the roadway behind the machine as the broom rotates. It would be desirable if a broom assembly could be provided for a sweeping machine with a collecting assembly that would provide a more effective seal of the roadway surface.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

Terms concerning attachments, coupling and the like, such as "connected" and "interconnected", refer to a relationship wherein structures are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity. Several terms are specifically defined herein. These terms are to be given their broadest possible construction consistent with such definitions, as follows:

The terms "lower", "bottom" and similar terms, when used in reference to a relative position or direction on or with respect to a vehicular sweeping machine, or an assembly, component or portion thereof, refer to a relative position or direction that is nearer the roadway on which the vehicular sweeping machine is placed for operation.

The terms "upper", "top" and similar terms, when used in reference to a relative position or direction on or with respect to a vehicular sweeping machine or an assembly, component or portion thereof, refer to a relative position or direction that is farther away from the roadway on which the vehicular sweeping machine is placed for operation.

The term "forward sweeping direction" is the direction that the operator of the vehicular sweeping machine faces when he is seated in the normal position for the operator of the vehicular sweeping machine.

The term "sweeping diameter", when used to describe a dimension of a broom, refers to the distance from the outer extent of a bristle of the broom to the outer extent of a bristle on the opposite side of the broom tube.

The term "in front of" and similar terms refer to an assembly, component or portion of a vehicular sweeping machine that is in the forward sweeping direction with respect to a reference point, assembly, component or portion of the vehicular sweeping machine.

The term "behind" and similar terms refer to an assembly, component or portion of a vehicular sweeping machine that is in the direction opposite the forward sweeping direction with respect to a reference point, assembly, component or portion of the vehicular sweeping machine.

The term "left", as used herein to describe a direction or relative position of a vehicular sweeping machine or an assembly, component or portion of such a sweeping machine, refers to a position or orientation towards the left, from the perspective of the operator who is driving the machine in the forward sweeping direction.

The term "right", as used herein to describe a direction or relative position of a vehicular sweeping machine or an assembly, component or portion of such a sweeping machine, refers to a position or orientation towards the right, from the perspective of the operator who is driving the machine in the forward sweeping direction.

The term "inside", as used herein to describe a direction or relative position of an assembly, component or portion of a vehicular sweeping machine, refers to a position or orientation away from the outer periphery of the vehicular sweeping machine or component or portion thereof.

The term "outside", as used herein to describe a direction or relative position of an assembly, component or portion of a vehicular sweeping machine, refers to a position or orientation towards the outer periphery of the vehicular sweeping machine or component or portion thereof.

The term "linear actuator" refers to an electric, pneumatic, hydraulic, electro-hydraulic or mechanical device that generates force which is directed in a straight line. Common examples of "linear actuators" are hydraulic and pneumatic actuators which include a cylinder, a piston within the cylinder, and a rod attached to the piston. By increasing the pressure within the cylinder on one side of the piston (over that on the opposite side of the piston), the rod will extend from the cylinder or retract into the cylinder.

The term "rotary actuator" refers to an electric, hydraulic or electro-hydraulic motor or other device that generates force that is directed along an arc or about a center of rotation.

The term "actuator" (without a qualifying adjective) refers to a linear actuator or a rotary actuator.

SUMMARY OF THE PREFERRED EMBODIMENTS OF THE INVENTION

The invention comprises a vehicular sweeping machine having a broom assembly that includes a plurality of links which are pivotally mounted between the frame and the broom assembly. These links are adapted to permit the broom assembly to move upwardly and downwardly with respect to the frame. Means are also provided for raising and lowering the broom assembly with respect to the frame.

A particularly preferred embodiment of the invention comprises a sweeping machine having a broom assembly with a broom enclosure that substantially encloses the broom and retains milled material within the broom enclosure regardless of the sweeping diameter of the broom employed. Yet another preferred embodiment of the invention comprises a broom assembly that includes a material presentation system and a collecting assembly that efficiently directs milled material onto the broom conveyor. Still another preferred embodiment of the invention comprises a sweeping machine having a broom assembly that is adapted for removal and replacement of brooms from the side of the machine.

In order to facilitate an understanding of the invention, the preferred embodiments of the invention, as well as the best mode known by the inventors for carrying out the invention, is illustrated in the drawings, and a detailed description thereof follows. It is not intended, however, that the invention be limited to the particular embodiment described or to use in connection with the apparatus illustrated herein. Therefore, the scope of the invention contemplated by the inventors includes all equivalents of the subject matter recited in the claims, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout, and wherein.

DESCRIPTION OF THE PREFERRED EMBODIMENTS OF THE INVENTION

Figure 1:
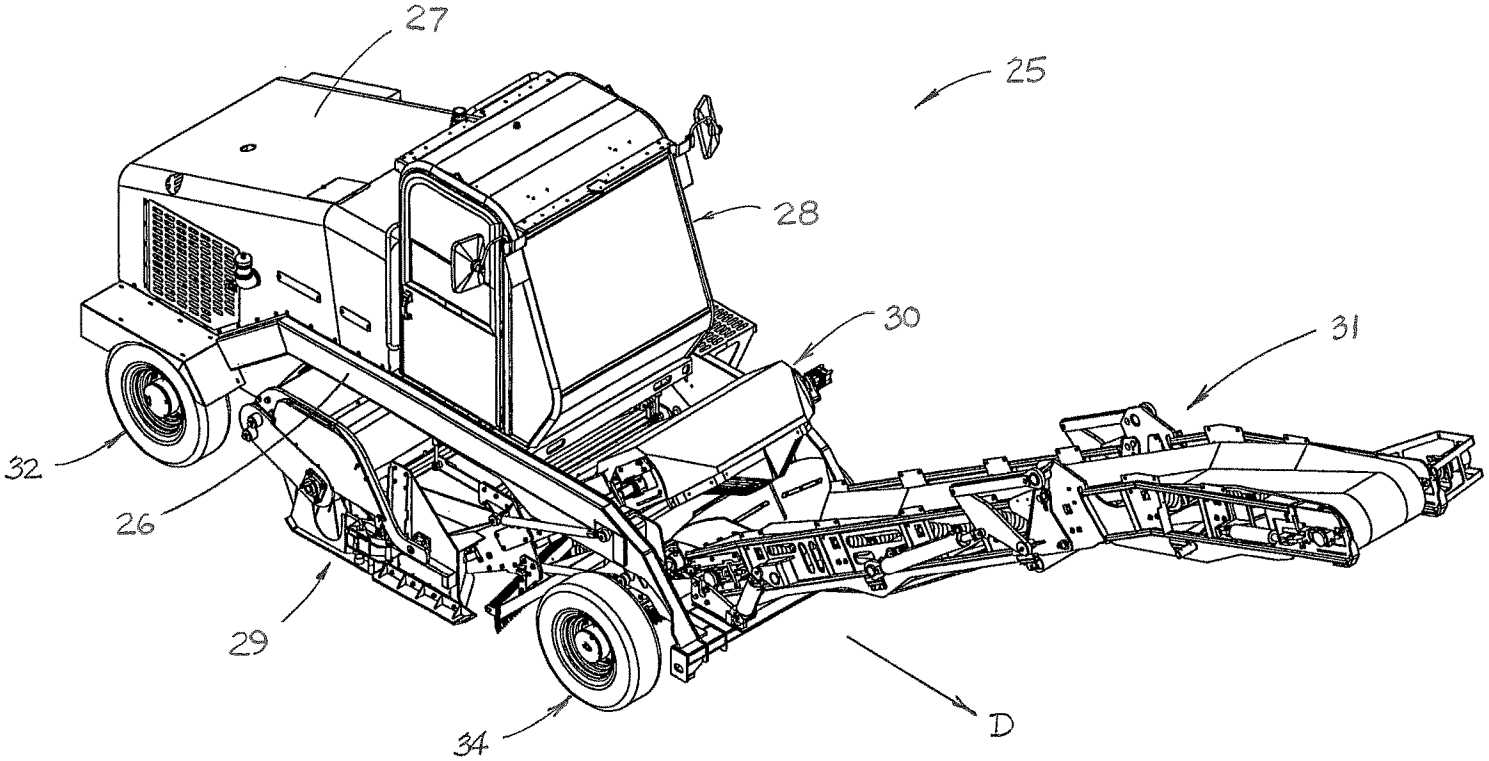
FIG. 1 is a right perspective view of a vehicular sweeping machine that is equipped with a preferred embodiment of the invention.

This description of preferred embodiments of the invention is intended to be read in connection with the accompanying drawings, which are to be considered part of the entire written description of this invention. The drawing figures are not necessarily to scale, and certain features of the invention may be shown exaggerated in scale or in somewhat schematic form in the interest of clarity and conciseness.

As shown in FIGS. 1-5, a first embodiment 25 of a vehicular sweeping machine includes frame 26, engine compartment 27, operator's cab 28, broom assembly 29, broom conveyor 30 and articulating discharge conveyor 31. Contained within engine compartment 27 is an engine (not shown) that provides power for driving rear wheels 32 of the machine, as well as for operating the broom assembly and other components of the vehicular sweeping machine. Steering of machine 25 is accomplished by means of a conventional steering assembly operating through front wheels 34. When machine 25 is driven in forward sweeping direction "D", it is desirable that the bottom of broom assembly 29 sits down on the sweeping surface to create a stable seal against the roadway. Such stability is provided by mounting the broom assembly 29 on frame 26 by means of a four-link arrangement comprised of a pair of lower links, right lower link 36 and left lower link 38, and a pair of upper links including right upper link 40 and a left upper link (not shown) that is mounted parallel to right upper link 40 on the left side of machine 25.

Figure 23:
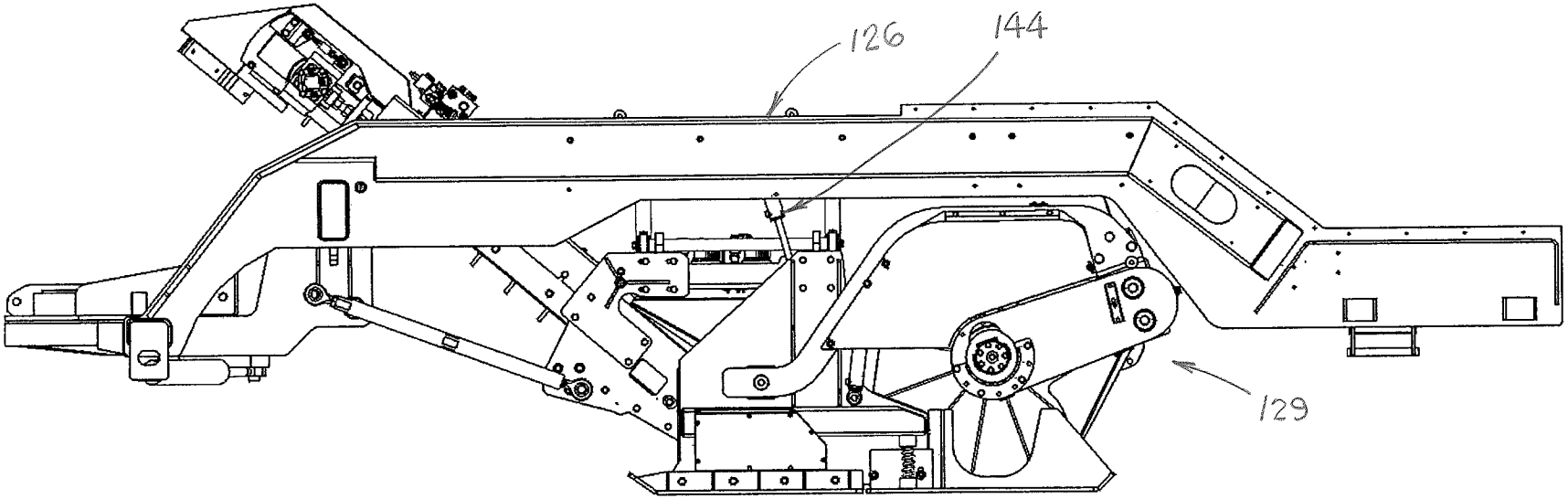
FIG. 23 is a left side view of an alternative embodiment of a portion of a vehicular sweeping machine that is similar in many respects to the vehicular sweeping machine shown in FIGS. 1-5.
Figure 24:
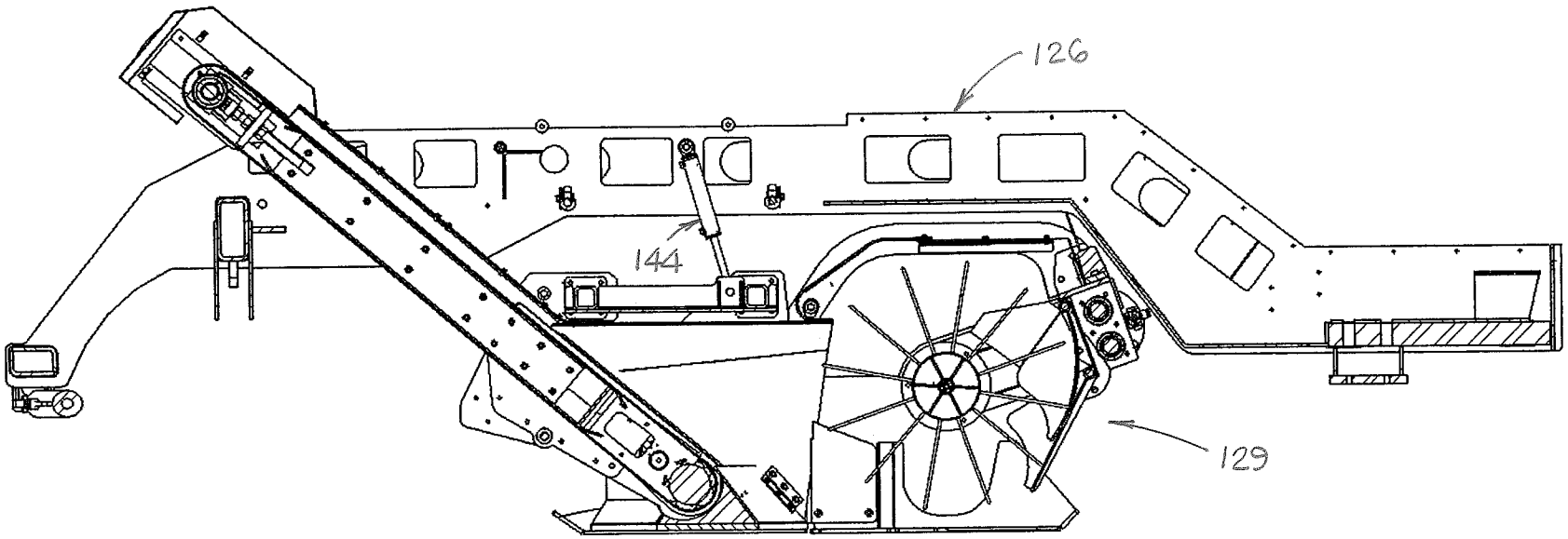
FIG. 24 is a left side view of the embodiment of the portion of the vehicular sweeping machine shown in FIG. 23, with a portion of the frame and certain other components removed for clarity.

Furthermore, a plurality of linear actuators are provided in this embodiment of the invention, including front linear actuator 42 and rear linear actuator 44, for raising and lowering the broom assembly with respect to the frame. In some embodiments of the invention, a pair of front linear actuators are provided, one on each side of the broom assembly, along with a pair of rear linear actuators (also located on opposite sides of the broom assembly). In other embodiments of the invention, only one or a plurality of rear linear actuators (such as rear linear actuator 44) will be required. Thus, for example, FIGS. 23 and 24 illustrate an alternative embodiment of a portion of vehicular sweeping machine 125 that is similar in many respects to vehicular sweeping machine 25 of FIGS. 1-5. In this embodiment of the invention, however, a single linear actuator 144 is mounted in a diagonal configuration between frame 126 and broom assembly 129.

Figure 6:
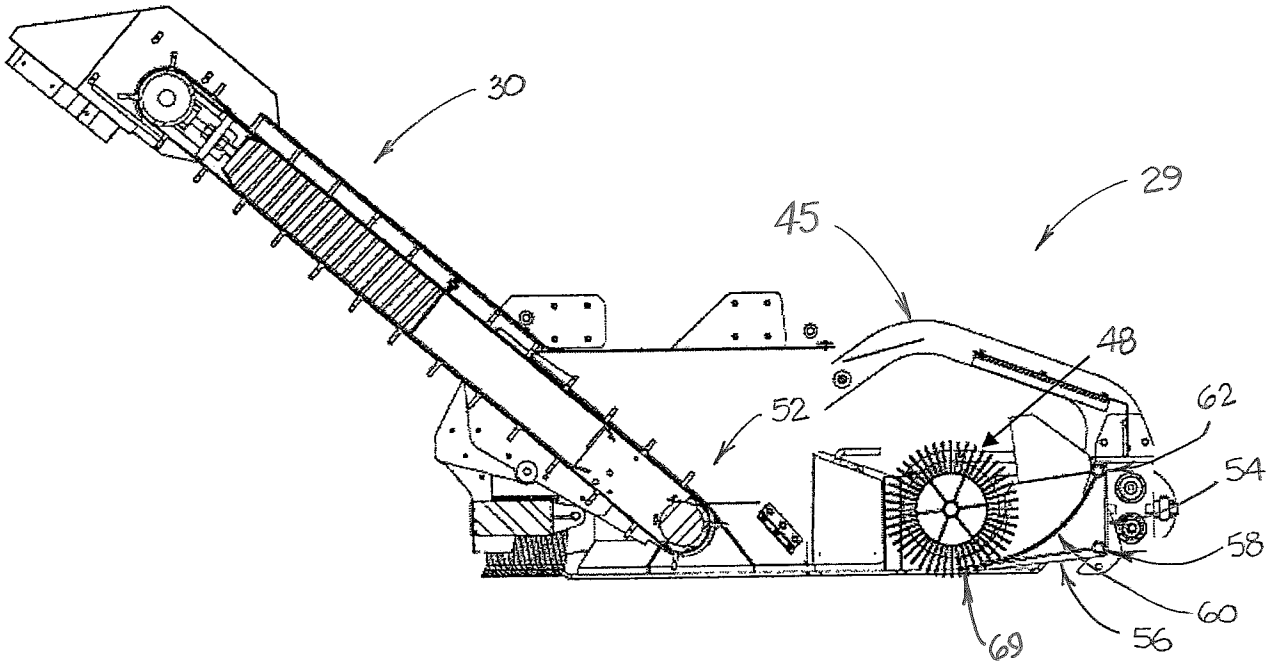
FIG. 6 is a sectional view of the broom assembly of a vehicular sweeping machine similar to that shown in FIGS. 1-5, but having a broom tube with short bristles thereon.
Figure 18:
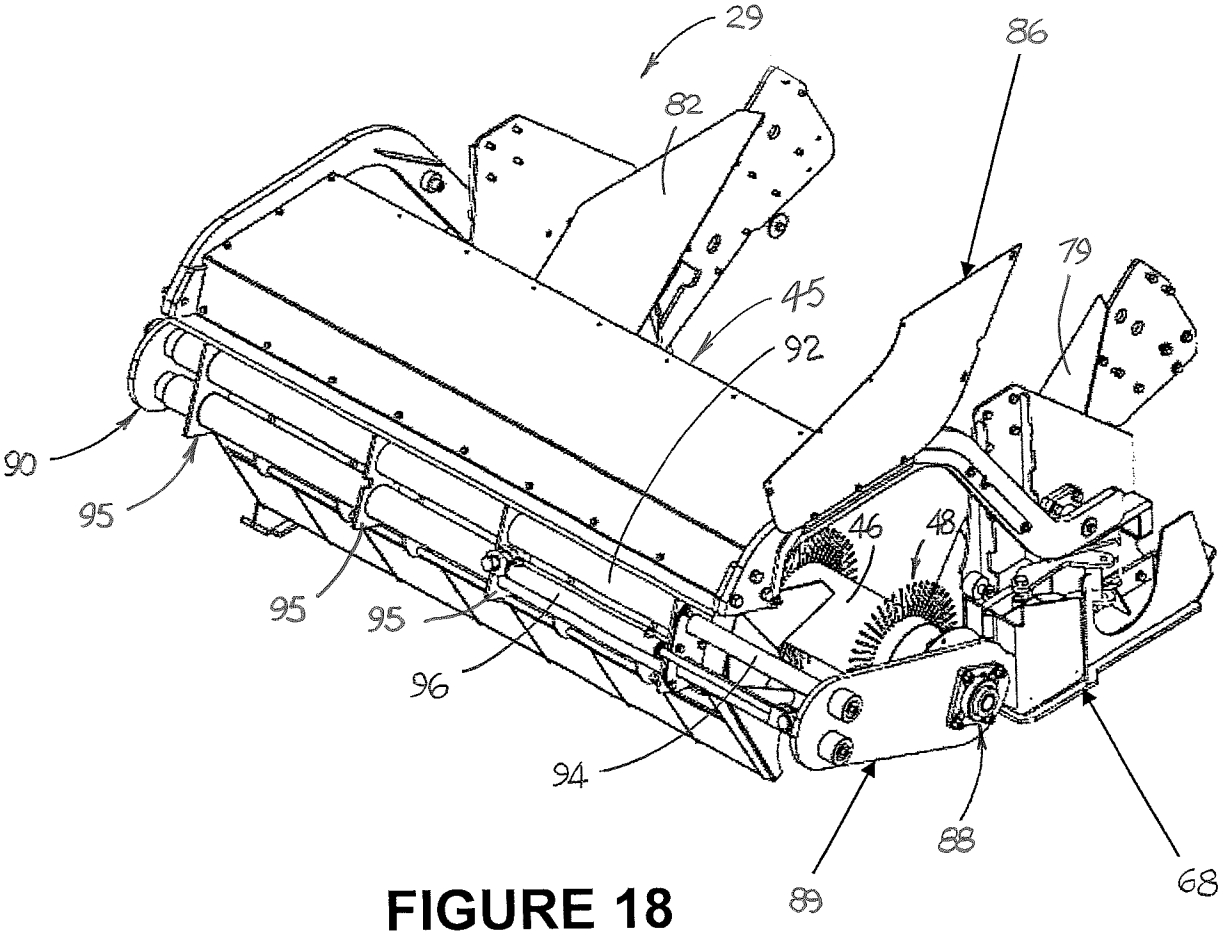
FIG. 18 is a left perspective view of the portion of the broom assembly illustrated in FIG. 17, showing the operation of certain components that facilitate easy replacement of a broom.
Figure 19:
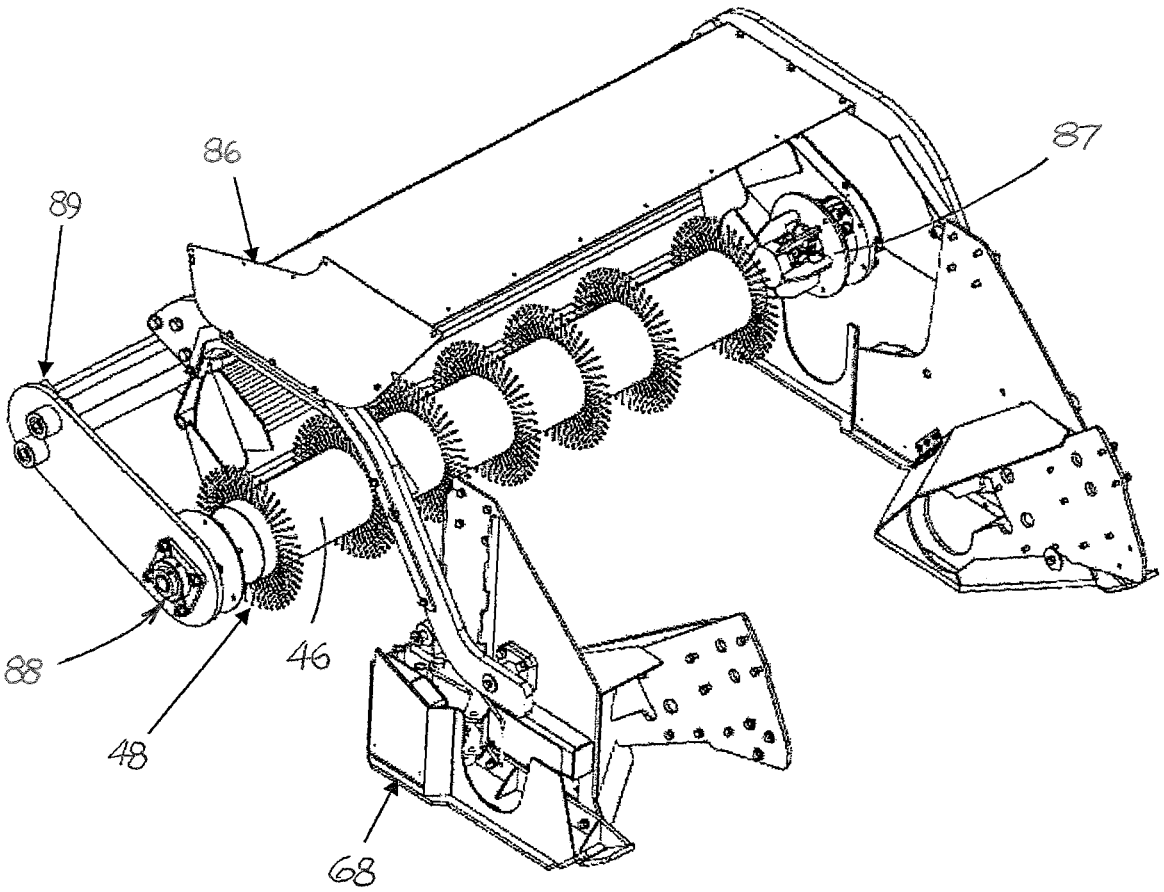
FIG. 19 is a left perspective view of the portion of the broom assembly illustrated in FIGS. 17 and 18, taken from a different angle from than of FIGS. 17 and 18, showing certain components that facilitate easy replacement of a broom.

Broom assembly 29 includes broom enclosure 45 and a broom comprising a generally cylindrical broom tube 46 with attached bristles that is adapted to rotate about a generally horizontal axis within the broom enclosure. The drawings show brooms having different bristle configurations and/or in different states of bristle wear. Thus, for example, FIGS. 6, 18 and 19 show broom tubes 46 with a plurality of short densely packed bristles 48 attached thereto, whereas FIGS. 2, 4, 7, 10, 11, 15 and 20-24 show broom tubes 46 with a plurality of longer, more widely-spaced bristles 50. It is important to realize that as the longer spaced bristles 50 of the embodiments shown in FIGS. 2, 4, 7, 10, 11, 15 and 20-24 wear, they may be reduced in length to a length similar to that of bristles 48 shown in FIGS. 6, 18 and 19.

When machine 25 is driven in forward sweeping direction "D", milling chips, dust and other material on the roadway will enter broom assembly 29 from its front side. The efficiency of the sweeping operation is facilitated by the four-link mounting arrangement of the broom assembly to the frame, and the linear actuator(s) associated therewith that may be employed to raise and lower the broom assembly with respect to the roadway. More particularly, this mounting arrangement comprises right upper link 40, which is pivotally mounted at one end to frame 26 and at the other end to an upper right position on broom assembly 29. Similarly, a left upper link (not shown but substantially identical to right upper link 40) is pivotally mounted at one end to frame 26 and at the other end to an upper left position on broom assembly 29 (opposite to the upper right mounting position of right upper link 40). Right lower link 36 is pivotally mounted at one end to frame 26 and at the other end to a lower right position on broom assembly 29, and left lower link 38 is pivotally mounted at one end to frame 26 and at the other end to a lower left position on broom assembly 29. Front linear actuator 42 and rear linear actuator 44 are each mounted between the broom assembly and the frame and are adapted to raise and lower the broom assembly with respect to the frame, and consequently, with respect to the roadway surface. In some embodiments of the invention (such as the embodiment illustrated in FIGS. 23 and 24), either or both of the front and rear linear actuators is mounted with one end pivotally attached to the frame on one side of the machine and the other end pivotally attached to the broom assembly on the opposite side of the machine. In other embodiments of the invention, the linear actuators may be mounted generally vertically in pairs with one end attached to the frame and the other end attached to the broom assembly. In these embodiments, one front linear actuator and one rear linear actuator are mounted generally vertically on one side of the machine and one front linear actuator and one rear linear actuator are mounted generally vertically on the other side of the machine. In addition to facilitating a sweep seal of the roadway, the mounting assembly comprising the four-link mounting arrangement and one or more linear actuators makes it easier to load the sweeping machine on a flatbed truck for transport to and from the sweeping site.

Figure 2:
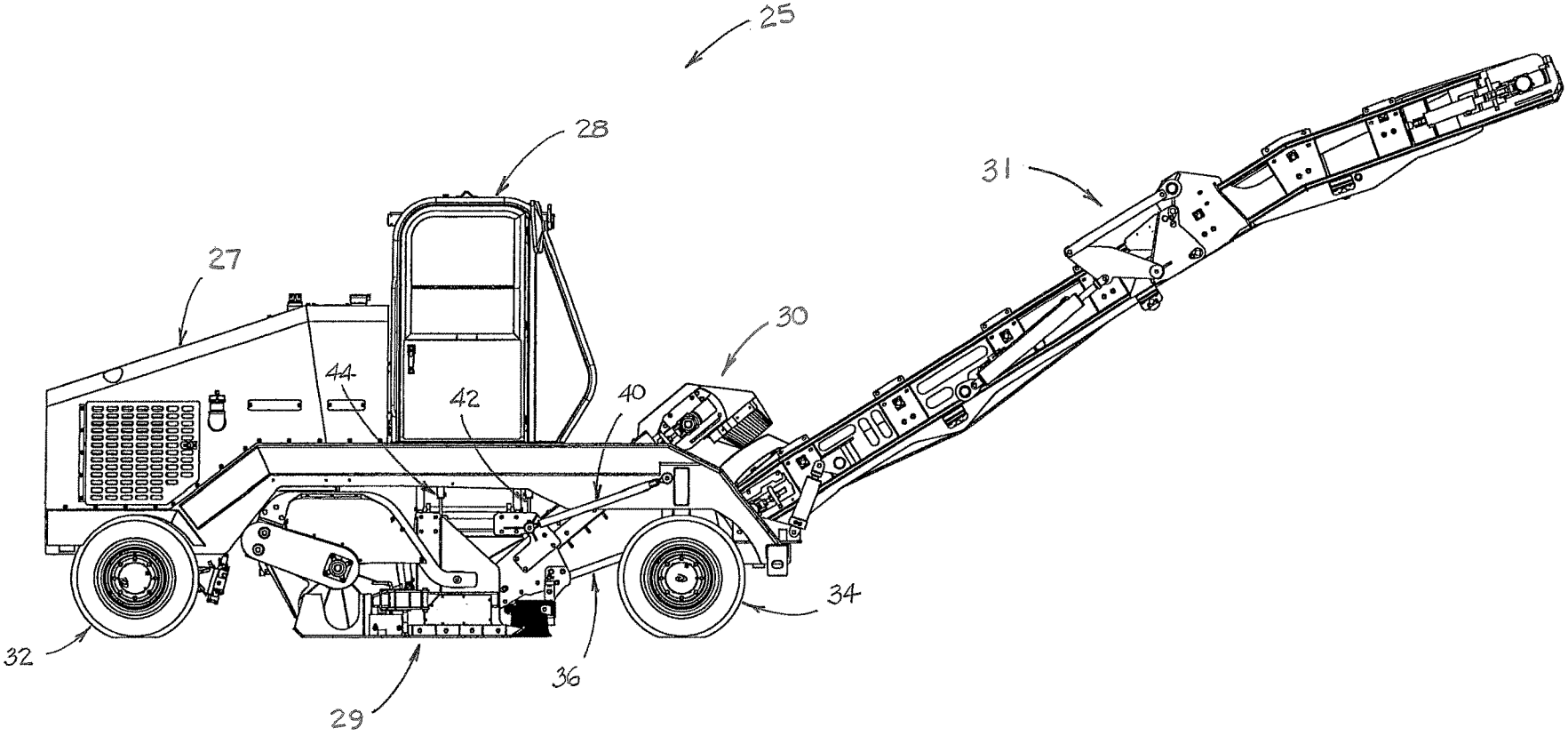
FIG. 2 is a right side view of the vehicular sweeping machine shown in FIG. 1.
Figure 3:
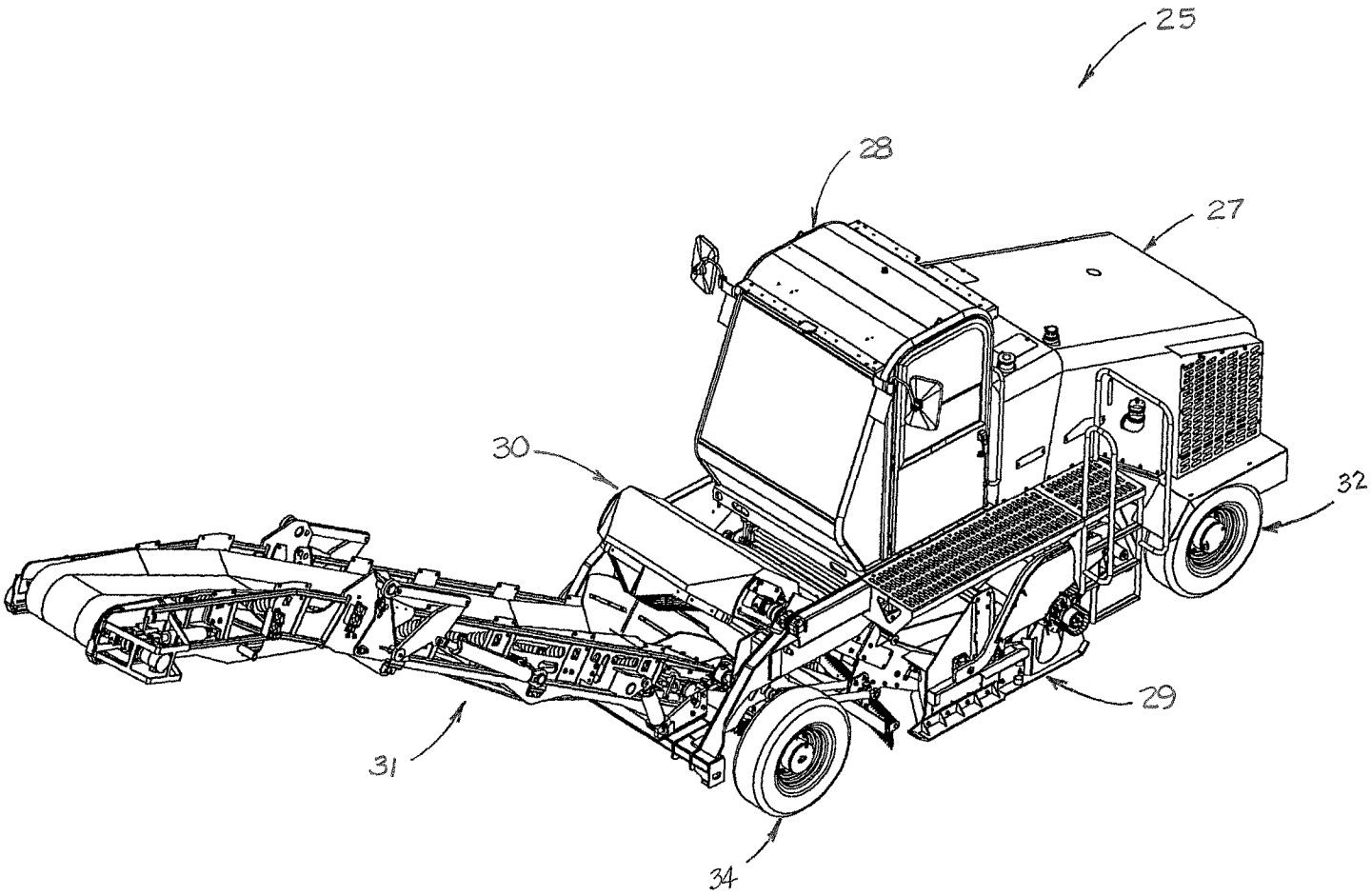
FIG. 3 is a left perspective view of the vehicular sweeping machine shown in FIGS. 1 and 2.
Figure 4:
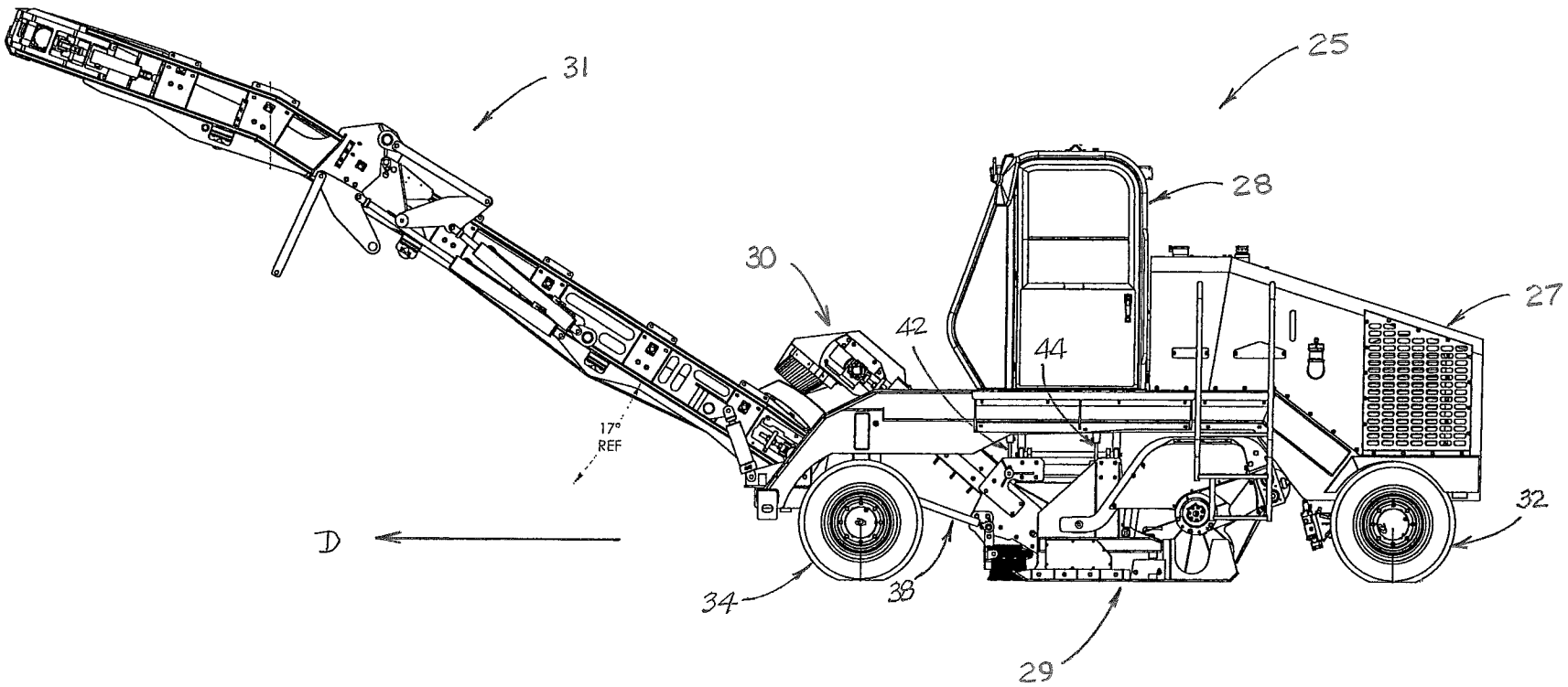
FIG. 4 is a left side view of the vehicular sweeping machine shown in FIGS. 1-3.
Figure 5:
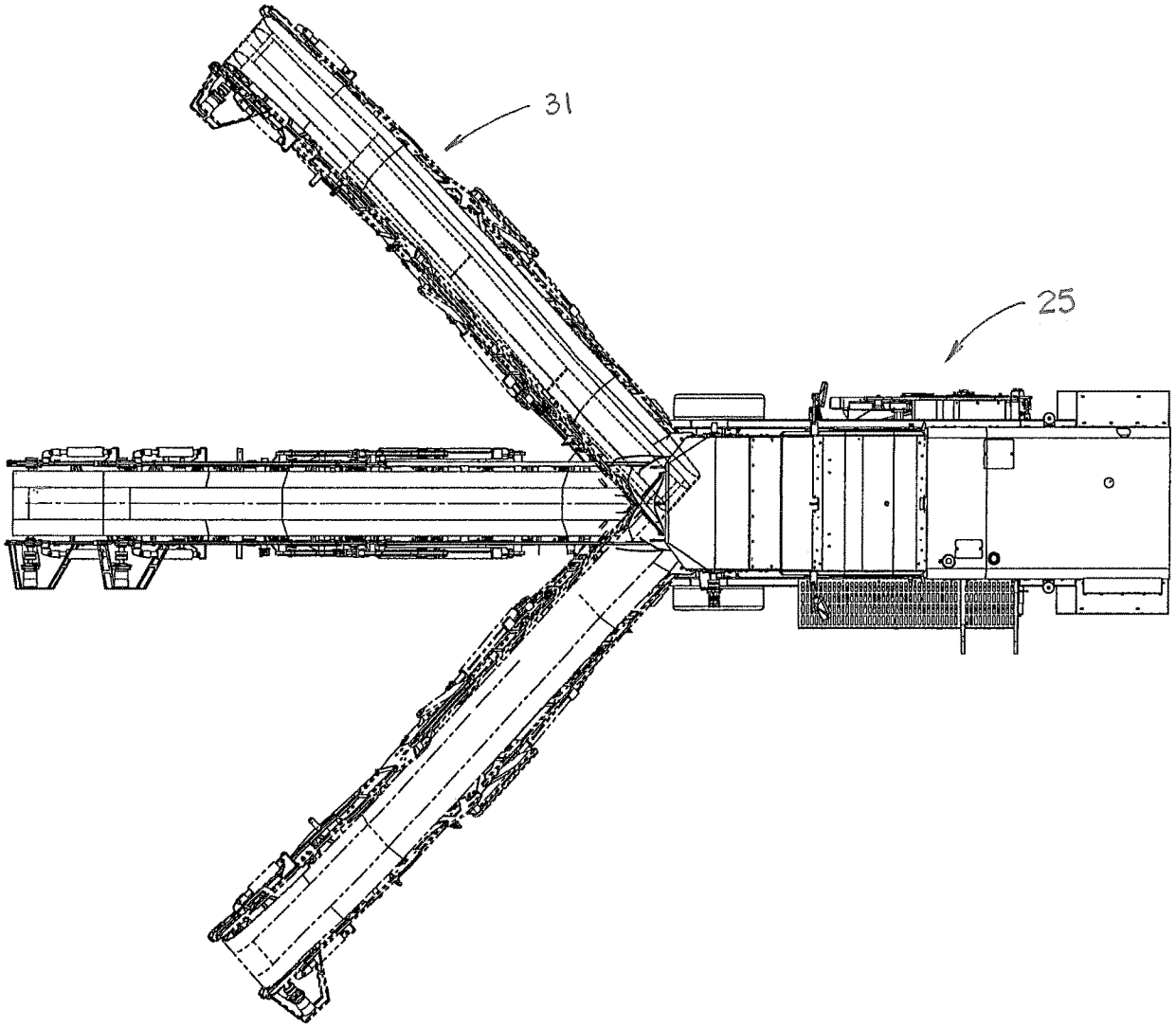
FIG. 5 is a top view of the vehicular sweeping machine shown in FIGS. 1-4.
Figure 7:
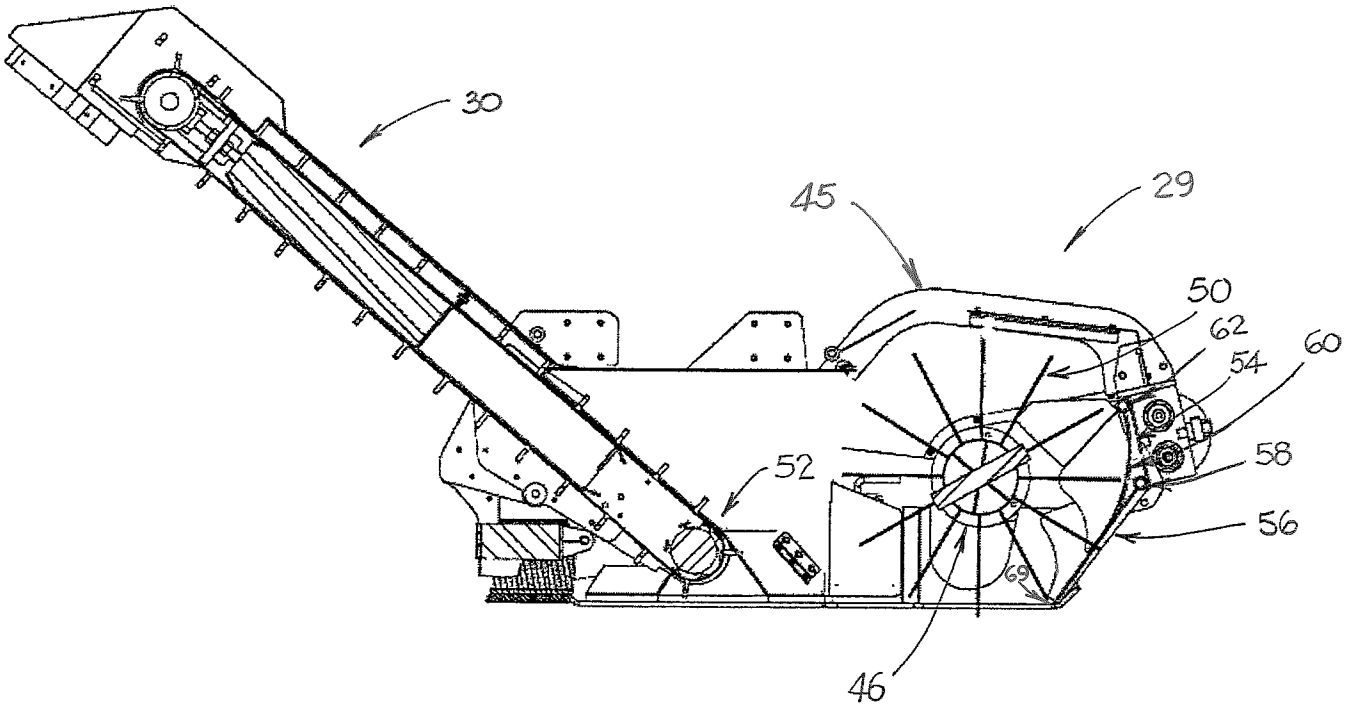
FIG. 7 is a sectional view of the broom assembly of the vehicular sweeping machine shown in FIGS. 1-5, showing a broom tube with long bristles thereon.
Figure 8:
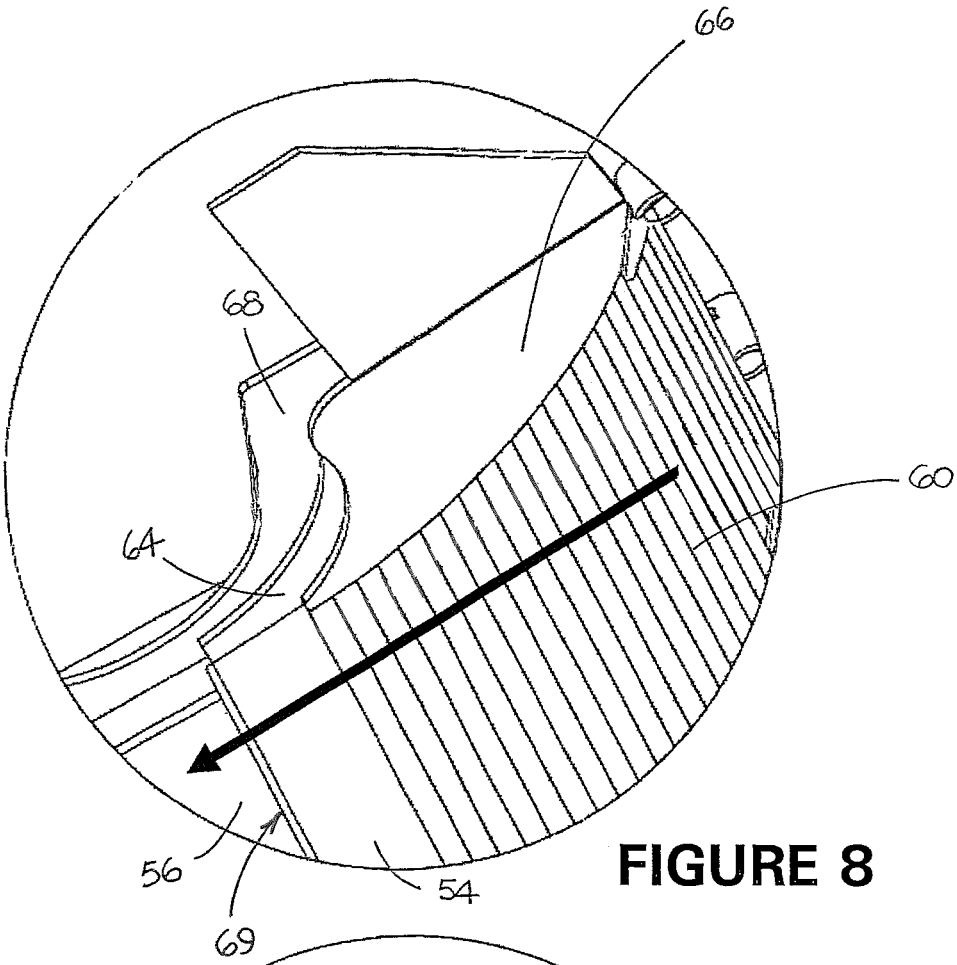
FIG. 8 is a first perspective view of a portion of the broom assembly of the vehicular sweeping machine shown in FIGS. 1-5, showing the operation of certain of the features of a preferred embodiment of the invention illustrated in FIGS. 6 and 7.
Figure 9:
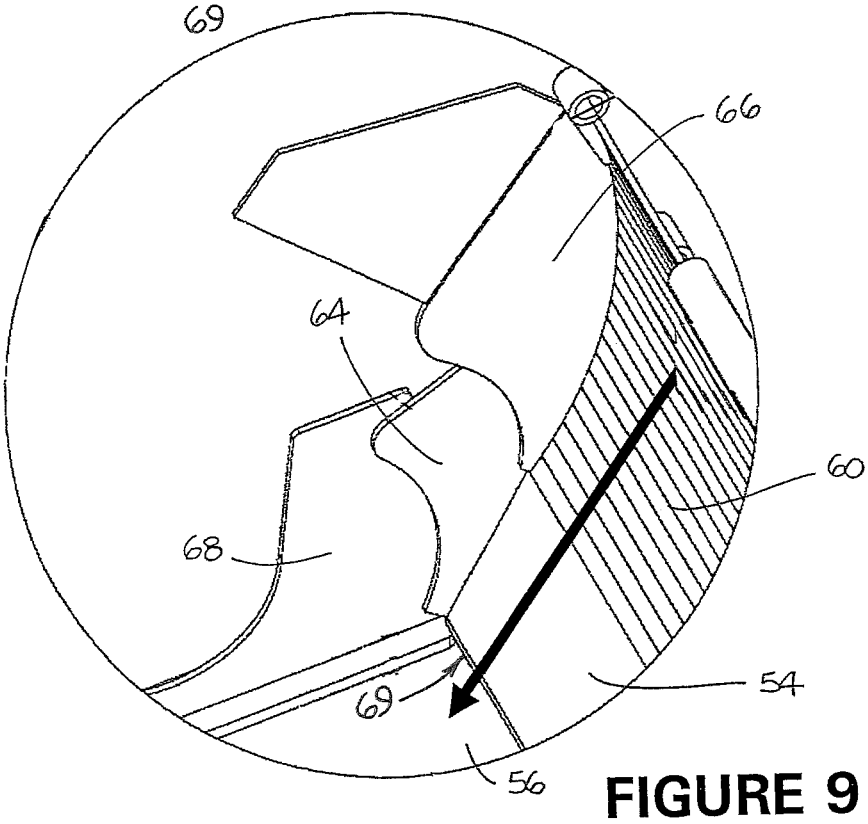
FIG. 9 is a second perspective view of a portion of the broom assembly of the vehicular sweeping machine shown in FIGS. 1-5, showing the operation of certain of the features of a preferred embodiment of the invention illustrated in FIGS. 6 and 7.

The broom may be rotated about a generally horizontal axis in a counterclockwise direction as viewed in FIG. 2, or in a clockwise direction as viewed in FIGS. 4, 6, 7, 10, 23 and 24. Because of the configuration of the broom enclosure, rotation of the broom in either direction causes much of the material on the roadway to be deposited onto lower end 52 of broom conveyor 30 for transport to discharge conveyor 31. However, some of the material from the roadway may be trapped in the bristles of the broom, and some material may be ejected away from the broom towards the top and/or rear of the broom enclosure. Such material is contained by the preferred broom enclosure which comprises a moldboard assembly having two layered moldboards arranged at the rear end of broom assembly 29 in such a way as to form a labyrinth seal that will trap material inside the broom enclosure. An outer moldboard comprises generally rigid upper panel 54 and generally rigid lower panel 56 that are joined together at hinge 58. An inner curved moldboard 60 is attached at the top of upper panel 54 of the outer moldboard by hinge 62. Upper panel 54 of the outer moldboard has a pair of integral side panels, including side panel 64 shown in FIGS. 8 and 9, and inner moldboard 60 also has a pair of integral side panels, including side panel 66 shown in FIGS. 8 and 9. The side panels slide across the end gates of the broom enclosure, including right end gate 68 shown in FIGS. 8 and 9, to insure that the broom is always enclosed by the end gates and moldboard assembly of the broom enclosure and by the underlying road surface when the sweeping machine is being operated. The combination of these features and the relative placement of the two moldboards causes the bristles of the broom to direct and contain the material within the broom enclosure, regardless of the length of the bristles of the broom, as can be seen by comparing FIGS. 6 and 7. Material that is ejected away from the broom towards the top and/or rear of the broom enclosure is directed by the moldboards down towards the roadway surface, so that it can be swept by the bristles of the broom onto lower end 52 of broom conveyor 30. The arrangement of the inner and outer moldboards is such that as the bristles of the broom wear and become shorter, thereby decreasing the sweeping diameter of the broom (or as brooms of different sizes are employed), the moldboards will always create a sloped surface that sheds material onto the roadway, as shown by the arrows in FIGS. 8 and 9, and will prevent the buildup of material within the broom enclosure behind the broom. The moldboard assembly is configured and arranged to automatically adjust to accommodate brooms having various bristle lengths. As shown in FIG. 7, the bristles 50 of a broom with a large sweeping diameter will contact the inside surface of inner moldboard 60 in such a way that the inside angle between upper panel 54 and lower panel 56 of the outer moldboard (i.e., the inside angle between upper panel 54 and lower panel 56 at hinge 58) is larger than in the configuration of FIG. 6 wherein contact of the bristles 48 of a broom with a smaller sweeping diameter with the inside surface of the inner moldboard causes the inside angle between upper panel 54 and lower panel 56 of the outer moldboard to be smaller. Thus, as shown in FIGS. 6-9, lower end 69 of inner moldboard 60 remains in contact with the bristles of the broom regardless of the length of such bristles.

Figure 10:
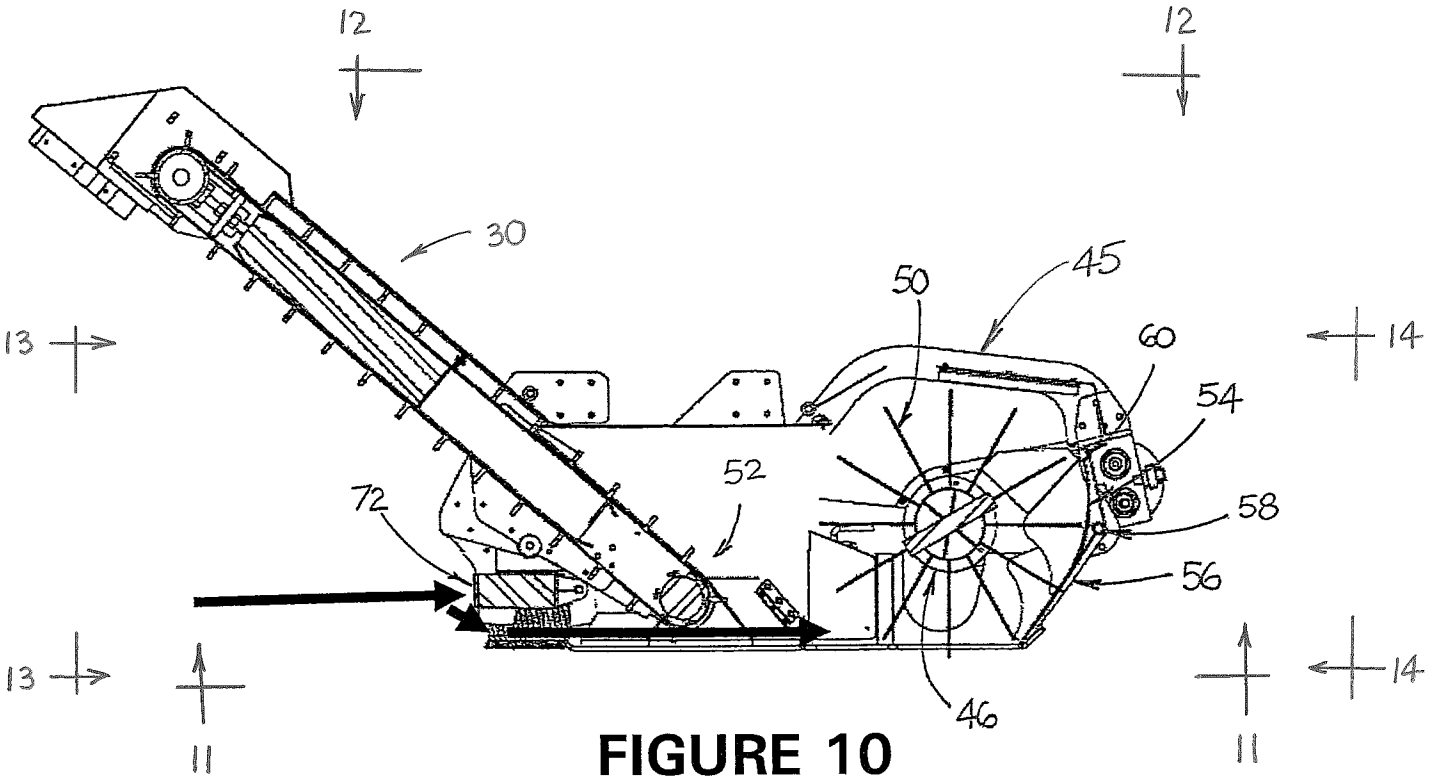
FIG. 10 is a sectional view of the broom assembly of the vehicular sweeping machine shown in FIGS. 1-5, showing certain features of a preferred embodiment of the invention.
Figure 11:
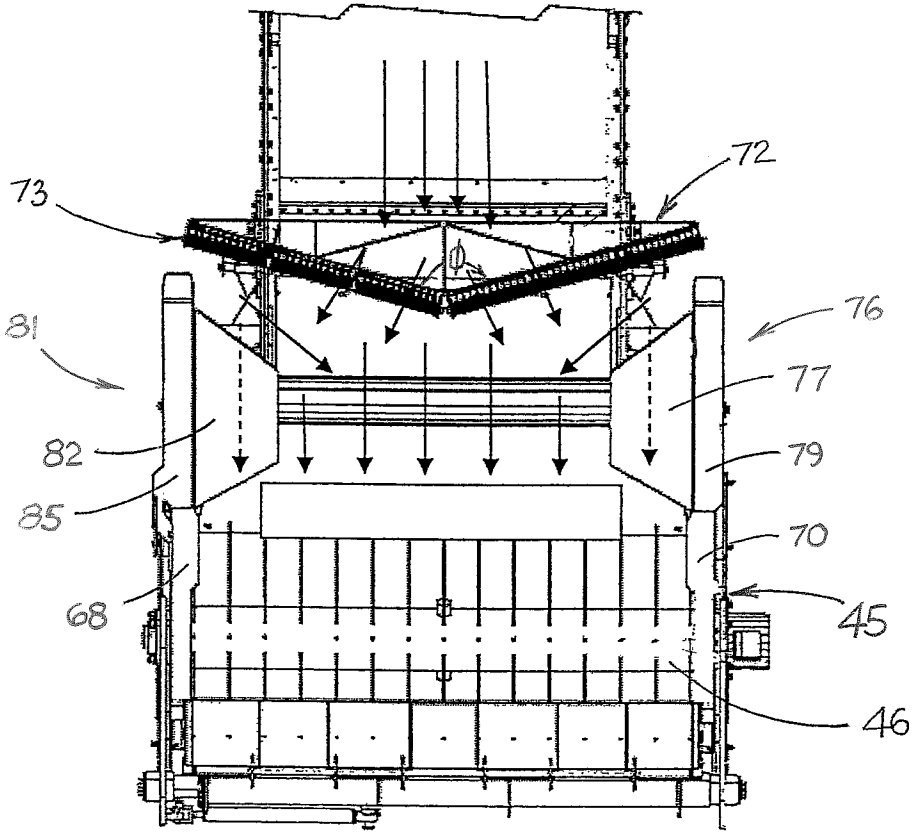
FIG. 11 is a bottom view of the broom assembly shown in FIG. 10, taken along the line 11-11 of FIG. 10.
Figure 12:
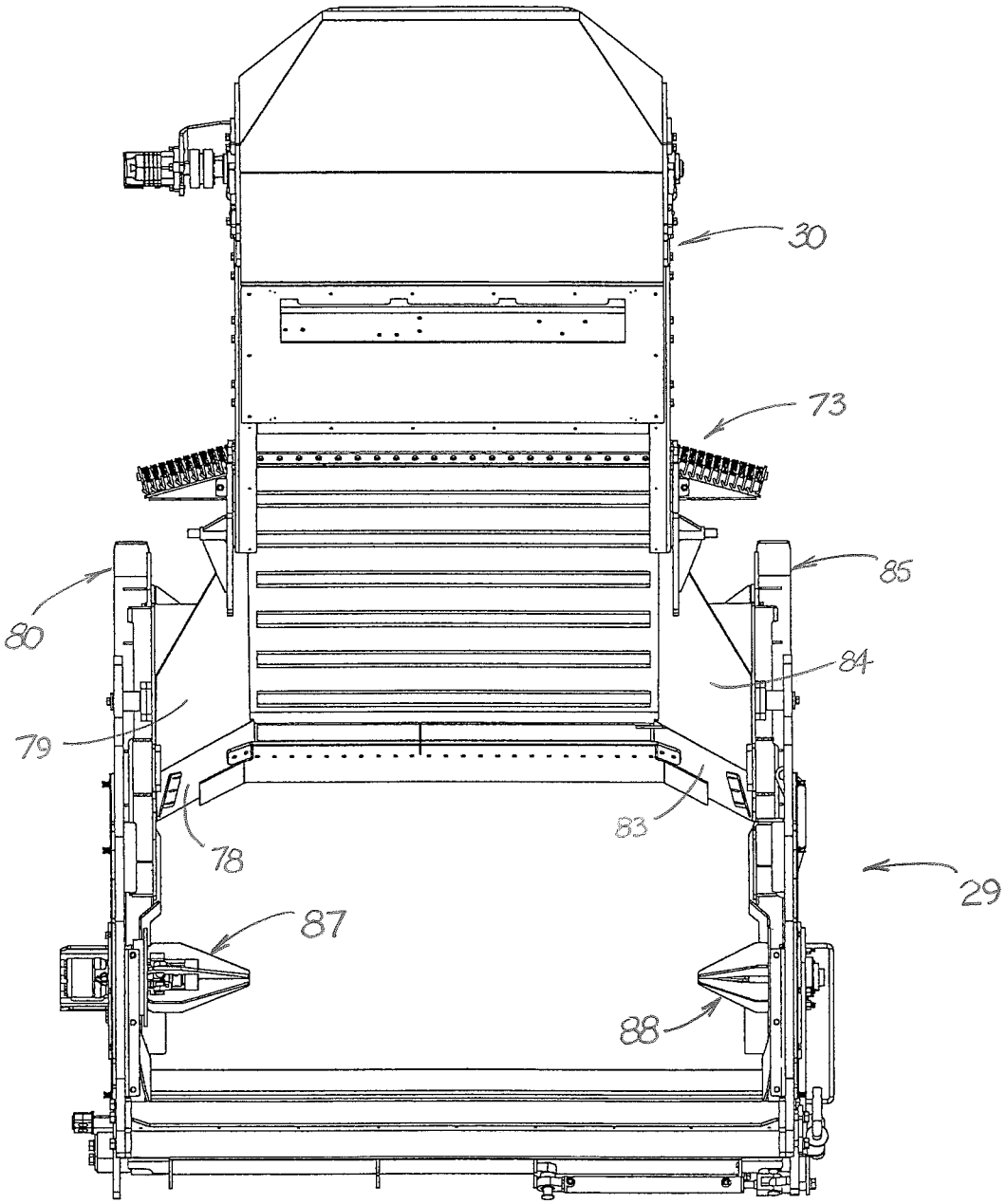
FIG. 12 is a top view of the broom assembly shown in FIGS. 10 and 11 (with certain structures removed), taken along the line 12-12 of FIG. 10.
Figure 13:
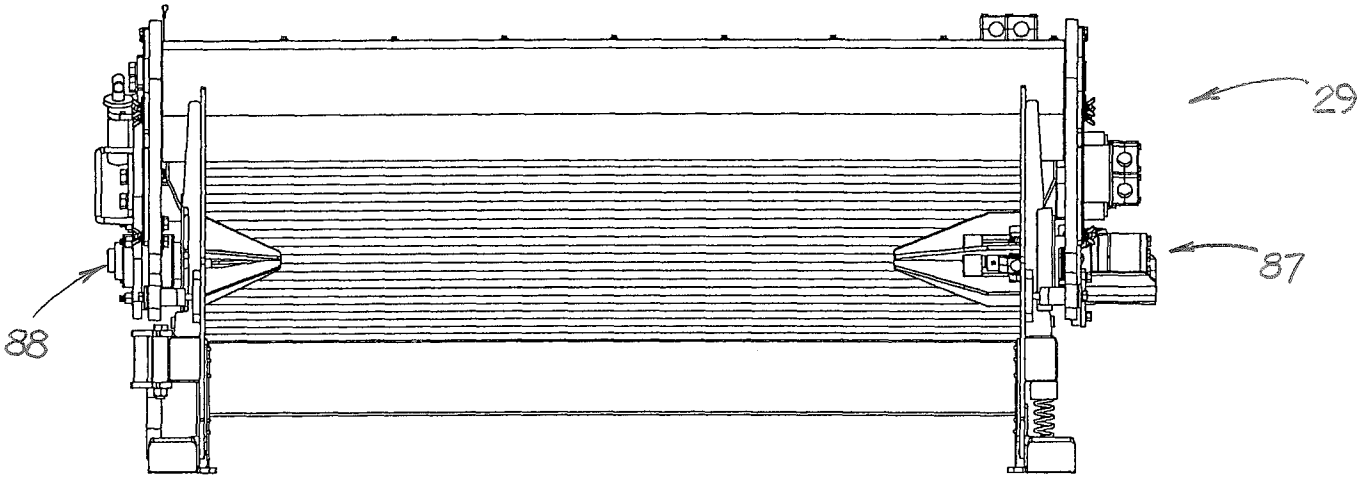
FIG. 13 is a front view of the broom assembly shown in FIGS. 10-12, taken along the line 13-13 of FIG. 10.
Figure 14:
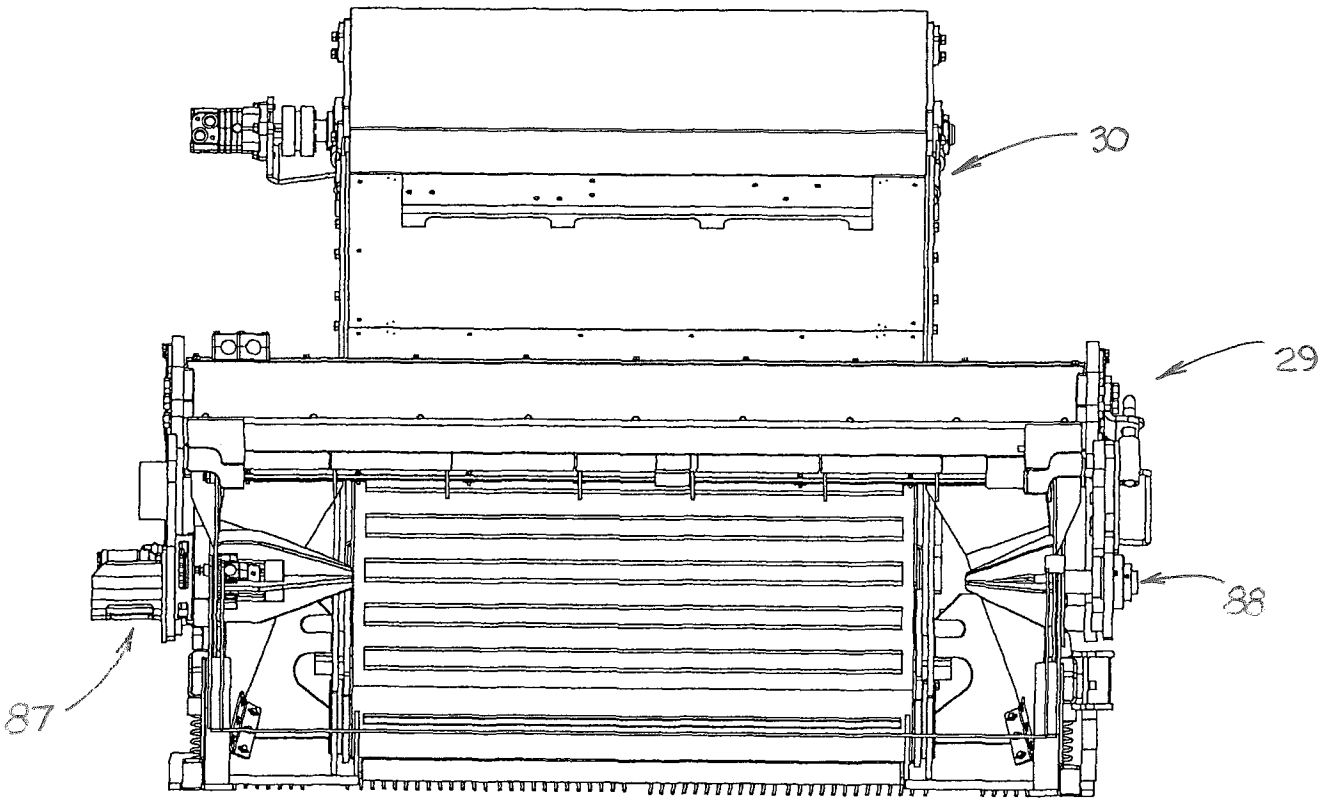
FIG. 14 is a rear view of the broom assembly shown in FIGS. 10-13, taken along the line 14-14 of FIG. 10.
Figure 15:
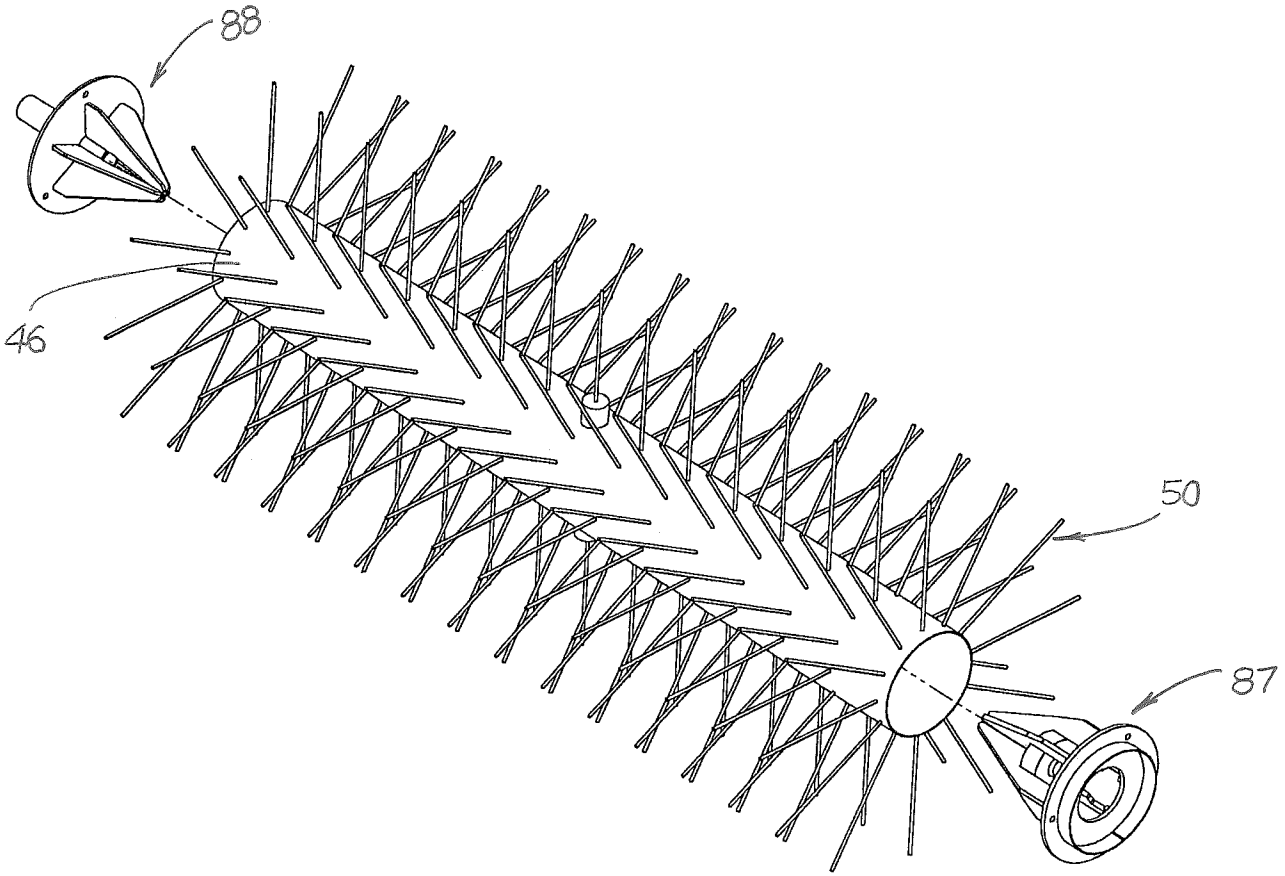
FIG. 15 is a perspective view of a broom that is shown in part in FIGS. 7, 10, 11 and 20-22, showing the drive and idler hubs associated therewith.
Figure 16:
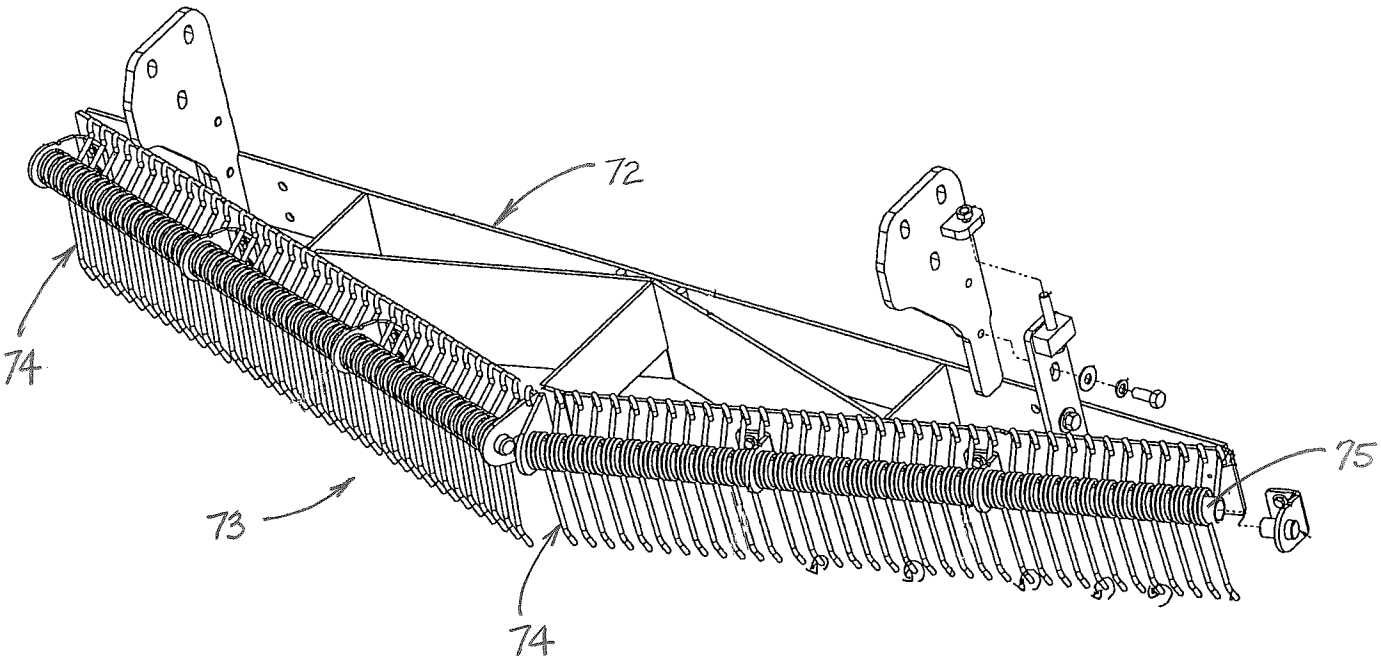
FIG. 16 is a perspective view of the V-shaped rake and knock-down plate of a preferred embodiment of the invention.

The operation of broom assembly 29 is rendered more efficient than that of conventional broom assemblies by a material presentation system comprising structures that control or condition material to be swept by the broom onto broom conveyor 30 for transport to discharge conveyor 31. Preferably, these structures serve to move material into contact with the broom in the form of a windrow that is located generally in front of the center of the broom assembly. The arrows in FIGS. 10 and 11 indicate the relative movement of material to be swept as vehicular sweeping machine 25 moves in the forward sweeping direction, i.e., in a direction towards the left side of the page on which FIG. 10 is displayed and in a direction towards the bottom of the page on which FIG. 11 is displayed. Certain of the novel structures of the material presentation system of broom assembly 29 serve to direct material to the broom and to prevent material from passing outside of the end gates of the broom enclosure. Thus, as shown in FIG. 11, right end gate 68 and left end gate 70 are located on opposite sides of broom tube 46, and knock-down blade 72 (also shown in FIGS. 10, 12 and 16) is located at the front of the broom assembly and somewhat above the surface of the roadway. The knock-down blade is adapted to control the height of the material on the roadway that is contacted by the broom. As shown in FIGS. 10, 11 and 16, knock-down blade 72 comprises a generally vertical face that is located at the front of broom assembly 29 below lower end 52 of broom conveyor 30. Attached to knock-down blade 72 is preferred V-shaped rake 73, best shown in FIG. 16, which is comprised of a plurality of spring steel tines 74 that are flexibly mounted to a pair of rake rods 75 in such a fashion that the tines will flex as they encounter material on the roadway surface. As shown in FIGS. 11 and 16, V-shaped rake 73 is preferably formed from two equal-sized rake portions (each comprising a rake rod and a plurality of tines) that meet at an obtuse angle Φ that is preferably equal to about 150°.

The knock-down blade regulates the height of material that is presented to the V-shaped rake, and the rake, which is located so as to contact the surface of the roadway, is adapted to pull up any material stuck to the roadway surface and to prevent material with relatively large particle size from contacting (and possibly damaging) the lower side of the belt on broom conveyor 30. The V-shaped rake also evens the height of the material across the width of the broom assembly and urges it into the restricted space between a pair of foot assemblies located behind the rake.

Left foot assembly 76 has a horizontally disposed left bottom panel 77 (shown in FIG. 11), an angled left lower wall 78 (shown in FIG. 12) and an angled left upper face 79 (shown in FIGS. 12, 17 and 18) that is adjacent to the left side of lower end 52 of broom conveyor 30. Preferably, the angle of left upper face 79 is generally the same as that of lower end 52 of broom conveyor 30 with respect to the roadway. Attached to the outside edge of bottom panel 77 is left foot ski 80, which is adapted to slide along the roadway as sweeping machine 25 is operated. Similarly, right foot assembly 81 has a horizontally disposed right bottom panel 82, an angled right lower wall 83 and an angled right upper face 84 that is adjacent the right lower end of broom conveyor 30. Preferably, the angle of right upper face 84 is generally the same as that of lower end 52 of broom conveyor 30. Attached to the outside edge of bottom panel 82 is right foot ski 85, which is adapted to slide along the roadway as the machine is operated. The foot assemblies are positioned on the broom assembly so that a small gap will be created between the bottom panels and the roadway surface, which allows a minimal amount of material to pass under the bottom panels, while the major portion of the material is redirected to the center of the broom assembly by rake 74 and foot assemblies 76 and 81. Any material that passes under the bottom panels is retained within the broom enclosure by end gates 68 and 70.

Figure 17:
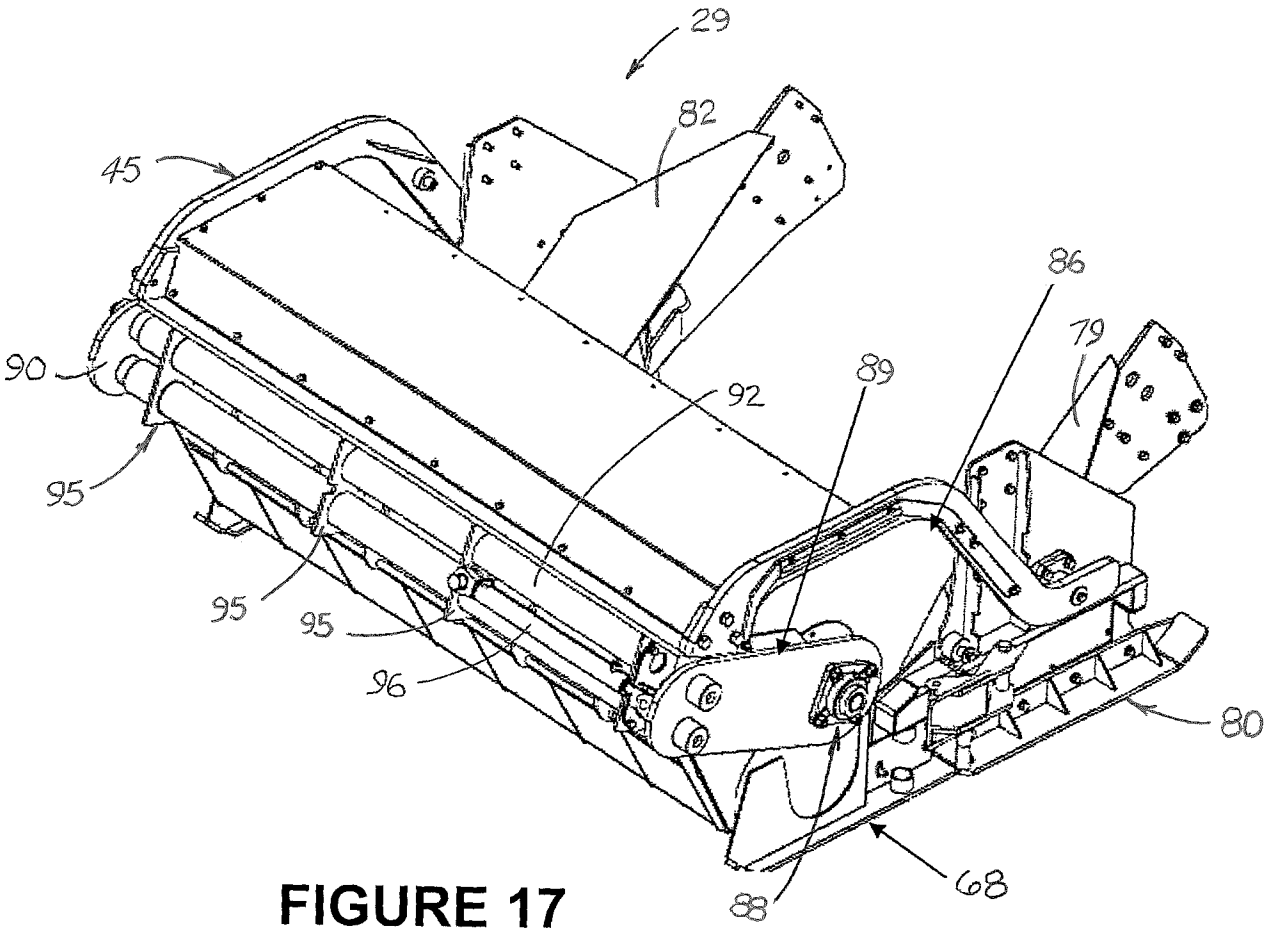
FIG. 17 is a left perspective view of a portion of the broom assembly of a vehicular sweeping machine similar to that shown in FIGS. 1-5, showing certain components that facilitate easy replacement of a broom.

In order to facilitate the removal and replacement of a broom core, at least one of the end gates of the broom enclosure is mounted so as to pivot about a generally vertical hinge towards the front of the broom assembly. Thus, right end gate 68 is pivotable from the closed position shown in FIG. 17 to the open position shown in FIGS. 18 and 19. In addition, right side head cover 86 is also part of the preferred broom enclosure and is attached with a generally horizontal hinge, so that it can be opened to allow the broom to be removed from the side of the broom enclosure. Thus, right side head cover 86 is pivotable from the closed position shown in FIG. 17 to the open position shown in FIG. 18. Broom tube 46 is mounted between a pair of hubs, including drive hub 87 on the left side, the generally conical inner broom engaging portion of which is shown in FIGS. 12-15 and 19, and idler hub 88, the generally conical inner broom engaging portion of which is shown in FIGS. 12-15 and the outer portion of which is shown in FIGS. 17-19. Drive hub 87 comprises or is attached to a rotary actuator that is adapted to rotate the broom about its axis of rotation. Idler hub 88 is attached to right hub mount arm 89, and drive hub 87 is attached to left hub mount arm 90, with each hub having an inner portion that extends through the hub mount arm for engagement with one of the ends of the broom tube, as best shown in FIGS. 12-15 and 17-19. Of course, it is contemplated within the scope of the invention that the drive hub could be attached to a right hub mount arm and the idler hub attached to a left hub mount arm. It is also contemplated within the scope of the invention that both hubs could be driven by or comprise rotary actuators.

Right hub mount arm 89 and left hub mount arm 90 are also mounted to the rear of the broom enclosure by a plurality of outer tubes 92 and inner telescoping tubes 94. In the embodiment of the invention shown in the drawings, each of the outer tubes is attached to left hub mount arm 90 and to a plurality of brackets 95 on the rear of the broom enclosure. Each of the inner telescoping tubes 94 has a fixed end that is attached to right hub mount arm 89 and a free end that is adapted to slide within the outer tube 92 with which it is associated. The free ends of the inner telescoping tubes move into and out of the outer tubes by the action of a linear actuator such as actuator 96 which is attached between the broom enclosure and right hub mount arm 89. Thus, as may be understood by comparing FIGS. 17 and 18, when right side head cover 86 is pivoted to the open position and right end gate 68 is pivoted to the open position, right hub mount arm 89 with attached broom tube 46 can be moved outwardly from the side of the broom assembly, as shown in FIGS. 18 and 19. This will disengage broom tube 46 from left hub 87. Then broom tube 46 can be disengaged from right hub 88 and removed from the machine. A new broom can then be installed by reversing this process.

Figure 20:
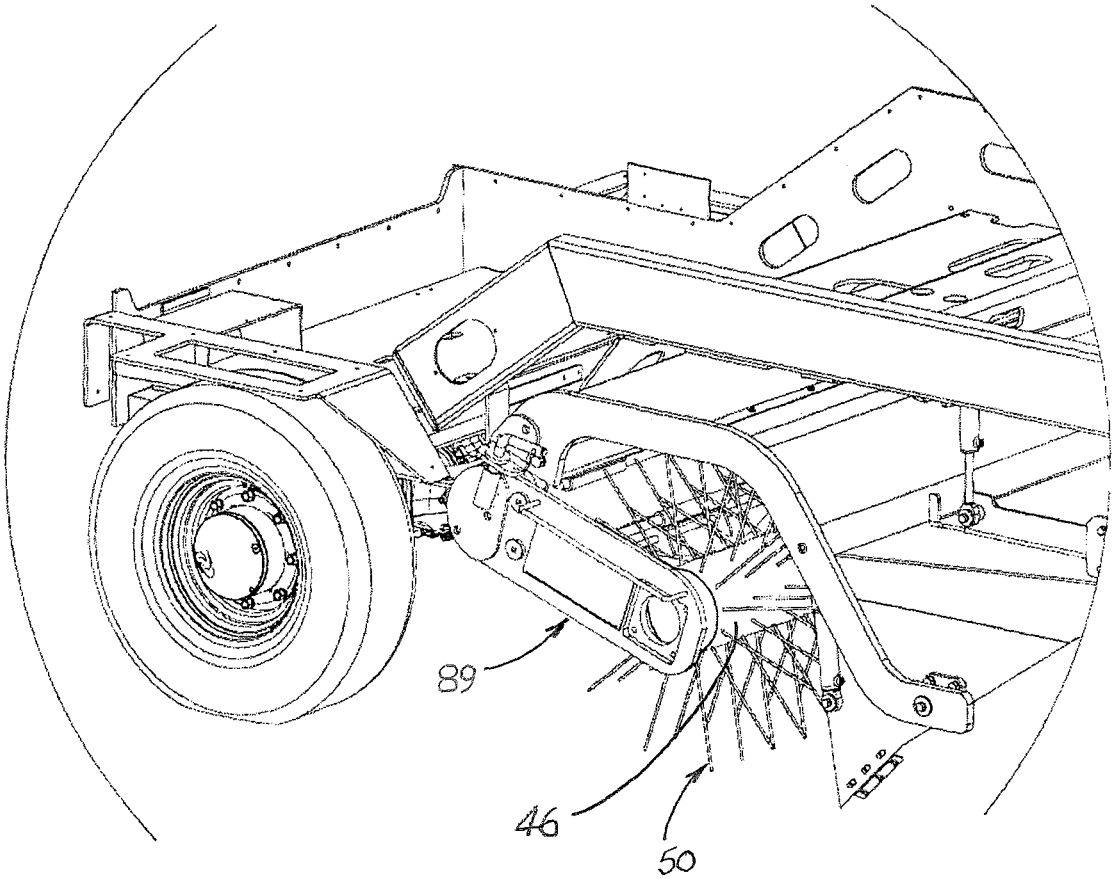
FIG. 20 is a left perspective view of a portion of the broom assembly of the vehicular sweeping machine shown in FIGS. 1-5, showing certain components that facilitate easy replacement of a broom.
Figure 21:
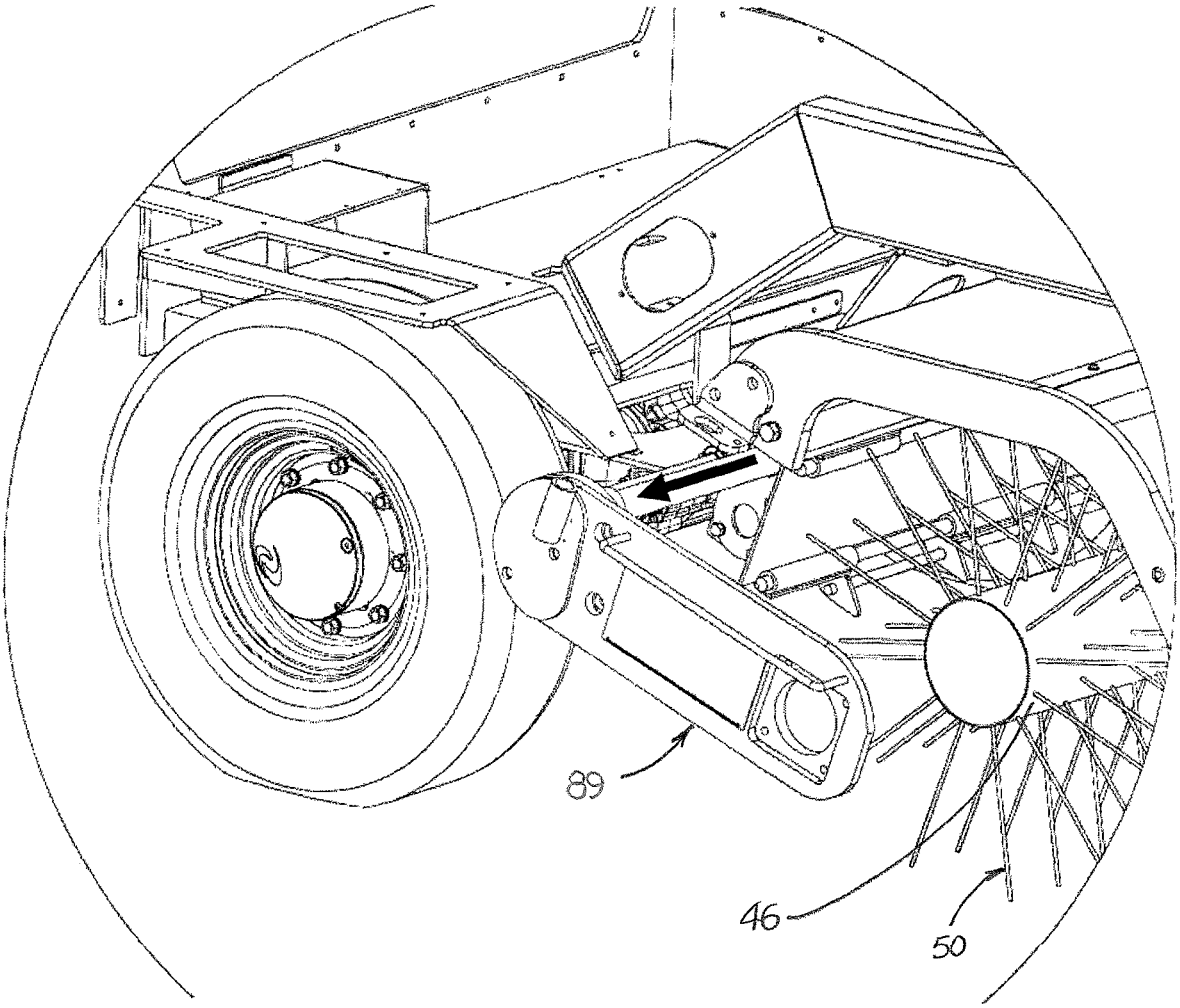
FIG. 21 is a left perspective view of the portion of the broom assembly illustrated in FIG. 20, showing certain components that facilitate easy replacement of a broom.
Figure 22:
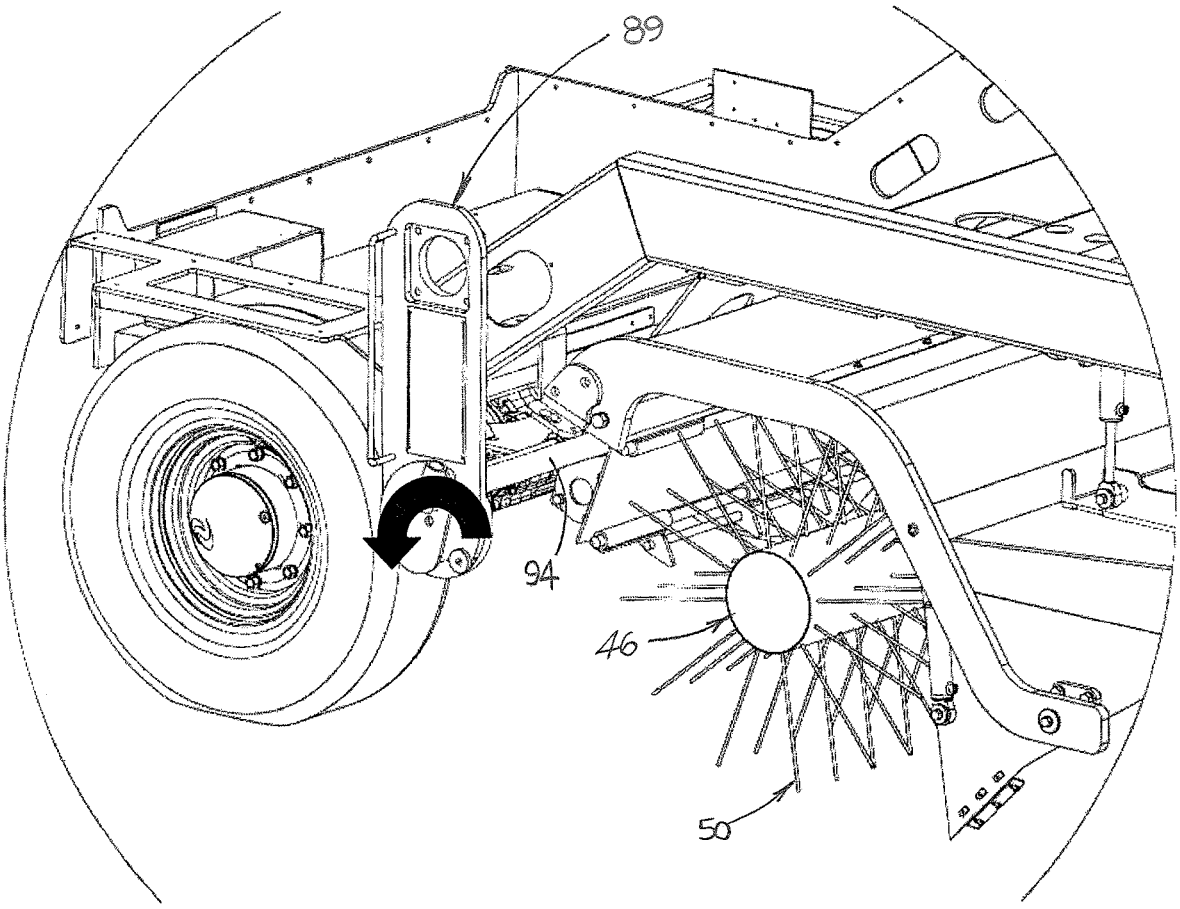
FIG. 22 is a left perspective view of the portion of the broom assembly illustrated in FIGS. 20 and 21, showing certain components that facilitate easy replacement of a broom.

FIGS. 20-22 illustrate additional features of a preferred embodiment of the invention. As shown therein, the hub (not shown) associated with right hub mount arm 89 can be withdrawn from broom tube 46 by moving right hub mount arm 89 outwardly from the side of the broom assembly. Right hub mount arm 89 may then be then rotated about an axis through the center of inner telescoping tube 94, as show in FIG. 22, to make it easier to remove broom tube 46 from the hub (not shown in FIG. 22) associated with left hub mount arm 90. After the broom tube is disengaged from the hubs on both sides, it can be easily removed from the machine. A new broom can then be installed by reversing this process.

The invention thus provides a fully-enclosed broom assembly that can more efficiently be operated to remove material milled by a milling machine from a roadway. Furthermore, even though the broom assembly is fully-enclosed, it can be manipulated with common tools and in a short period of time to allow for removal and replacement of the broom.

Although this description contains many specifics, these should not be construed as limiting the scope of the invention, but as merely providing illustrations of the presently preferred embodiment thereof, as well as the best mode contemplated by the inventors of carrying out the invention. The invention, as described herein, is susceptible to various modifications and adaptations, as would be understood by those having ordinary skill in the art to which the invention relates.

What is claimed is:

1. A vehicular sweeping machine comprising:

(a) a frame;

(b) means for driving the vehicular sweeping machine in a forward sweeping direction along a roadway having a roadway surface;

(c) a broom assembly that is mounted to the frame, said broom assembly having a front side, a rear end and a center, and further comprising:

(i) a broom enclosure having a front end and a rear end and further comprising:

(A) a left end gate;

(B) a right end gate;

(C) a moldboard assembly comprising an outer moldboard and an inner moldboard, said outer moldboard and inner moldboard being arranged to form a labyrinth seal at the rear end of the broom enclosure;

(ii) a broom that is mounted within the broom enclosure, said broom comprising a generally cylindrical tube with attached bristles having a bristle length, said broom being adapted to rotate about a generally horizontal axis;

(iii) a plurality of links that are pivotally mounted between the frame and the broom assembly, said plurality of links being adapted to permit the broom assembly to move upwardly and downwardly with respect to the frame;

(iv) means for raising and lowering the broom assembly with respect to the frame;

(d) a broom conveyor having a lower end that is disposed within the broom enclosure.

2. The vehicular sweeping machine of claim 1:

(a) wherein the plurality of links comprises:

(i) a right upper link having two ends, said right upper link being pivotally mounted at one end to the frame and at the other end to an upper right position on the broom assembly;

(ii) a left upper link having two ends, said left upper link being pivotally mounted at one end to the frame and at the other end to an upper left position on the broom assembly;

(iii) a right lower link having two ends, said right lower link being pivotally mounted at one end to the frame and at the other end to a lower right position on the broom assembly;

(iv) a left lower link having two ends, said left lower link being pivotally mounted at one end to the frame and at the other end to a lower left position on the broom assembly;

(b) wherein the means for raising and lowering the broom assembly with respect to the frame comprises a linear actuator that is mounted between the broom assembly and the frame.

3. The vehicular sweeping machine of claim 1 wherein the means for raising and lowering the broom assembly with respect to the frame comprises a pair of linear actuators located on opposite sides of the broom assembly and mounted between the rear end of the broom assembly and the frame.

4. The vehicular sweeping machine of claim 1 wherein the broom enclosure substantially encloses the broom.

5. The vehicular sweeping machine of claim 1 wherein the arrangement of the outer moldboard and the inner moldboard provides a sloped moldboard surface at the rear end of the broom enclosure that sheds material onto the roadway surface on which the machine is operated regardless of the bristle length of the bristles of the broom.

6. The vehicular sweeping machine of claim 5 wherein the moldboard assembly comprises:

(a) the outer moldboard further comprising:

(i) a generally rigid upper panel having a top and a pair of integral side panels;

(ii) a generally rigid lower panel that is joined to the upper panel with a hinged attachment, wherein said upper panel and said lower panel form an inside angle at said hinged attachment;

(b) the inner moldboard further comprising an inner curved moldboard panel, said inner curved moldboard panel being attached at the top of the upper panel of the outer moldboard by a hinge, said inner moldboard having an inside surface, a lower end and a pair of integral side panels, said pair of integral side panels being adapted to slide across the end gates of the broom enclosure.

7. The vehicular sweeping machine of claim 6 wherein the moldboard assembly is configured and arranged to automatically adjust to accommodate the broom regardless of the bristle length of its bristles.

8. The vehicular sweeping machine of claim 7 wherein the outer moldboard and the inner moldboard are configured and arranged with respect to the broom so that the lower end of the inner moldboard remains in contact with the bristles of the broom regardless of the bristle length of such bristles.

9. The vehicular sweeping machine of claim 8 wherein the outer moldboard and the inner moldboard are configured and arranged so that the bristles of the broom which is provided with bristles having a bristle length which creates a large sweeping diameter will contact the inside surface of the inner moldboard in such a way that the inside angle between the upper panel and the lower panel of the outer moldboard is larger than the inside angle between the upper panel and the lower panel when the bristles of the broom which is provided with bristles having a bristle length which creates a smaller sweeping diameter contact the inside surface of the inner moldboard.

10. The vehicular sweeping machine of claim 1 wherein:

(a) the broom assembly includes:

(i) a left hub mount arm having a left hub mounted thereto, said left hub having an inner broom engaging portion on an inside of the left hub mount arm;

(ii) a right hub mount arm having a right hub mounted thereto, said right hub having an inner broom engaging portion on an inside of the right hub mount arm;

(iii) an outer tube that is attached to the rear end of the broom enclosure and to one of the left and right hub mount arms;

(iv) an inner tube having a fixed end that is attached to the left or right hub mount arm to which the outer tube is not attached, said inner tube also having a free end that is adapted to slide within the outer tube;

(v) a linear actuator that is attached between the broom enclosure and the left or right hub mount arm to which the fixed end of the inner tube is attached, said linear actuator being adapted to move the hub mount arm to which it is attached between an inner position in which the broom is engaged with the inner broom engaging portion of the left hub and the inner broom engaging portion of the right hub and an outer position in which the broom is disengaged from one or both of the inner broom engaging portion of the left hub and the inner broom engaging portion of the right hub;

(b) the broom is mounted between the inner broom engaging portion of the left hub and the inner broom engaging portion of the right hub.

11. The vehicular sweeping machine of claim 1 wherein the broom assembly includes a material presentation system, said material presentation system being adapted to move material on the roadway surface into contact with the broom in the form of a windrow that is located generally in front of the center of the broom assembly.

12. The vehicular sweeping machine of claim 1 wherein the broom assembly includes:

(a) a knock-down blade that is located on the front side of the broom assembly and above the roadway surface and is adapted to control a height of the material on the roadway surface that is contacted by the broom;

(b) a rake which is located behind the knock-down blade and in contact with the roadway surface.

13. The vehicular sweeping machine of claim 12 wherein the rake comprises a rake rod and a plurality of tines which are flexibly mounted thereto.

14. The vehicular sweeping machine of claim 13 wherein the rake is V-shaped and comprises two equal-sized rake portions, which rake rods meet at an angle of about 150°.

15. The vehicular sweeping machine of claim 1 wherein the broom assembly comprises:

(a) the lower end of the broom conveyor which further comprises a left side and a right side;

(b) a left end gate and a right end gate on opposite sides of the broom enclosure;

(c) a knock-down blade that is located at the front of the broom assembly and above the roadway surface so as to control a height of material on the roadway surface that is contacted by the broom;

(d) a left foot assembly comprising:

(i) a horizontally disposed left bottom panel;

(ii) an angled left lower wall;

(iii) an angled left upper face that is adjacent to the left side of the lower end of the broom conveyor;

(e) a right foot assembly comprising:

(i) a horizontally disposed right bottom panel;

(ii) an angled right lower wall;

(iii) an angled right upper face that is adjacent to the right side of the lower end of the broom conveyor.

16. The vehicular sweeping machine of claim 15 wherein:

(a) the left foot assembly:

(i) includes a left foot ski which is adapted to slide along the roadway;

(ii) is positioned on the broom assembly so that a gap is created between the left bottom panel and the roadway surface;

(b) the right foot assembly:

(i) includes a right foot ski which is adapted to slide along the roadway;

(ii) is positioned on the broom assembly so that a gap is created between the right bottom panel and the roadway surface.

* * * * *